US011085006B2

(12) United States Patent
Kwak

(10) Patent No.: US 11,085,006 B2
(45) Date of Patent: Aug. 10, 2021

(54) LUBRICANTS FOR ELECTRIC AND HYBRID VEHICLE APPLICATIONS

(71) Applicant: Afton Chemical Corporation, Richmond, VA (US)

(72) Inventor: Yungwan Kwak, Glen Allen, VA (US)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 16/509,845

(22) Filed: Jul. 12, 2019

(65) Prior Publication Data

US 2021/0009920 A1 Jan. 14, 2021

(51) Int. Cl.

| | |
|---|---|
| ***C10M 169/04*** | (2006.01) |
| *C10N 20/04* | (2006.01) |
| *C10N 30/02* | (2006.01) |
| *C10N 30/04* | (2006.01) |
| *C10N 30/06* | (2006.01) |
| *C10N 30/10* | (2006.01) |
| *C10N 30/12* | (2006.01) |
| *C10N 30/18* | (2006.01) |
| *C10N 30/00* | (2006.01) |
| *C10N 40/04* | (2006.01) |

(52) U.S. Cl.

CPC .. *C10M 169/044* (2013.01); *C10M 2207/282* (2013.01); *C10M 2209/084* (2013.01); *C10N 2020/04* (2013.01); *C10N 2030/02* (2013.01); *C10N 2030/04* (2013.01); *C10N 2030/06* (2013.01); *C10N 2030/10* (2013.01); *C10N 2030/12* (2013.01); *C10N 2030/18* (2013.01); *C10N 2030/60* (2020.05); *C10N 2040/04* (2013.01)

(58) Field of Classification Search

CPC ..... C10M 2209/084; C10M 2207/282; C10M 129/72; C10N 2030/60; C10N 2040/04; C10N 2040/14

See application file for complete search history.

(56) References Cited

U.S. PATENT DOCUMENTS

| | | | |
|---|---|---|---|
| 4,859,352 | A | 8/1989 | Waynick |
| 6,586,374 | B1 | 7/2003 | Paul |
| 6,667,281 | B2 | 12/2003 | Ikejima et al. |
| 6,903,056 | B2 | 6/2005 | Nagano et al. |
| 8,143,202 | B2 | 3/2012 | Peer et al. |

(Continued)

FOREIGN PATENT DOCUMENTS

| | | |
|---|---|---|
| WO | 2014186318 | 11/2014 |
| WO | 2017189277 | 11/2017 |
| WO | 2017210388 | 12/2017 |

OTHER PUBLICATIONS

International Search Report; dated Oct. 6, 2020 for PCT Application No. PCT/US 20/40440.

*Primary Examiner* — Ellen M McAvoy

(74) *Attorney, Agent, or Firm* — Honigman LLP

(57) ABSTRACT

The present disclosure relates to methods of lubricating an electric or a hybrid-electric transmission using a lubricant including a solvent system with a blend of one or more base oils with a branched diester and one or more poly(meth) acrylate copolymers, transmissions therefor, and lubricating compositions suitable for such applications that exhibit good lubricant properties, good electrical properties, and good cooling efficiency at the same time.

17 Claims, 1 Drawing Sheet

(56) References Cited

U.S. PATENT DOCUMENTS 8,400,030 B1* 3/2013 Tang ..... B60H 1/00271 310/54
8,563,486 B2 10/2013 Tsujimoto et al.
8,664,169 B2 3/2014 Bouffet
8,901,052 B2 12/2014 Sagawa et al.
8,999,904 B2 4/2015 Matsui et al.
9,522,972 B2 12/2016 Visger et al.
9,598,658 B2 3/2017 Scanlon et al.
9,896,634 B2 2/2018 Gao et al.
9,944,877 B2 4/2018 Gao et al.
2007/0037715 A1 2/2007 Okada
2008/0194442 A1* 8/2008 Watts ..... C10M 141/10 508/272
2008/0302422 A1 12/2008 Neveu et al.
2012/0208731 A1* 8/2012 Lann ..... C10M 141/12 508/187
2012/0283159 A1 11/2012 Matsui et al.
2014/0249061 A1 9/2014 Youn et al.
2014/0296118 A1 10/2014 Costello et al.
2015/0322322 A1 11/2015 Sondjaja et al.
2016/0108337 A1 4/2016 Abraham et al.
2017/0130161 A1 5/2017 Vettel et al.
2017/0306259 A1 10/2017 Ding et al.
2018/0072962 A1* 3/2018 Wada ..... C10M 145/14
2018/0079990 A1 3/2018 Aoyama
2018/0100114 A1 4/2018 Gao et al.
2018/0100115 A1 4/2018 Gao et al.
2018/0100117 A1 4/2018 Flores-Torres et al.
2018/0100118 A1 4/2018 Flores-Torres et al.
2018/0100119 A1 4/2018 Aoyama
2018/0134983 A1 5/2018 Broutin et al.
2018/0327687 A1 11/2018 Kwak
2019/0002785 A1* 1/2019 Sanson ..... C10M 129/70
2019/0002790 A1* 1/2019 Sanson ..... C10M 145/14
2019/0112541 A1* 4/2019 Hamachi ..... C10M 145/14
2019/0367830 A1* 12/2019 Iwai ..... C10M 145/14
2020/0248095 A1* 8/2020 Guerin ..... C10M 119/02
2020/0277542 A1* 9/2020 Salvi ..... C10M 169/04
2020/0332218 A1* 10/2020 Susukida ..... C10M 145/14

* cited by examiner

LUBRICANTS FOR ELECTRIC AND HYBRID VEHICLE APPLICATIONS

TECHNICAL FIELD

The present disclosure relates to lubricating compositions for electric or hybrid-electric vehicle transmissions, additives for such lubricating compositions, methods of lubricating an electric or hybrid-electric vehicle transmission, and to the electric or hybrid-electric vehicle transmission including such lubricants.

BACKGROUND

Electric and hybrid-electric vehicles may contain a power source (a traditional combustion engine such as a gasoline or diesel engine and/or a battery source coupled to an electric motor) combined with a transmission for transferring power to the wheels of the vehicle. The transmission may include an electric motor and/or a gear reduction unit coupled to the wheels. In some applications, a lubricant reservoir is provided containing a lubricant composition for lubricating both the electric motor and the power gear reduction unit.

In electric and hybrid-electric vehicle applications, the lubricating fluid that may be in contact with parts of the electric motor as well as parts of a traditional combustion engine gear reduction unit. As such, suitable fluids must have applicability for very distinct types of vehicle componentry. For example, the lubricating fluid may be in contact with electrical windings in the motor stator as well as the gears in the mechanical portions of the transmission. Suitable fluids for these applications, therefore, not only must have traditional lubricating properties, but also need to be compatible with electronic componentry.

Prior lubricants for transmissions typically required low friction and anti-wear capability, stability against heat and oxidization, as well as detergency and dispersancy capabilities. In order to achieve such characteristics, prior lubricants generally included a base oil and a variety of additives such as anti-oxidants, detergents/dispersants, anti-wear agents, rust inhibitors, metal deactivators, friction modifiers, anti-foam agents, seal swell agents, and viscosity index improvers.

To be suitable for electric components, the fluids must simultaneously provide good lubricating, electrical conductivity, and cooling performance. Often, one or more of the desired properties needed for electric and hybrid-electric applications is compromised do to the collection of additives commonly used in such traditional fluids and, thus these traditional fluids may be unsuitable for electric or hybrid-electric vehicles. That is, some traditional lubricant packages may have low electrical conductivity but have poor thermal conductivity (providing poor cooling performance). Other traditional lubricant packages may have high thermal conductivity (providing good cooling capability) but have poor electrical conductivity. Thus, such prior fluids do not provide optimal performance for these unique applications.

SUMMARY

Figure 1:
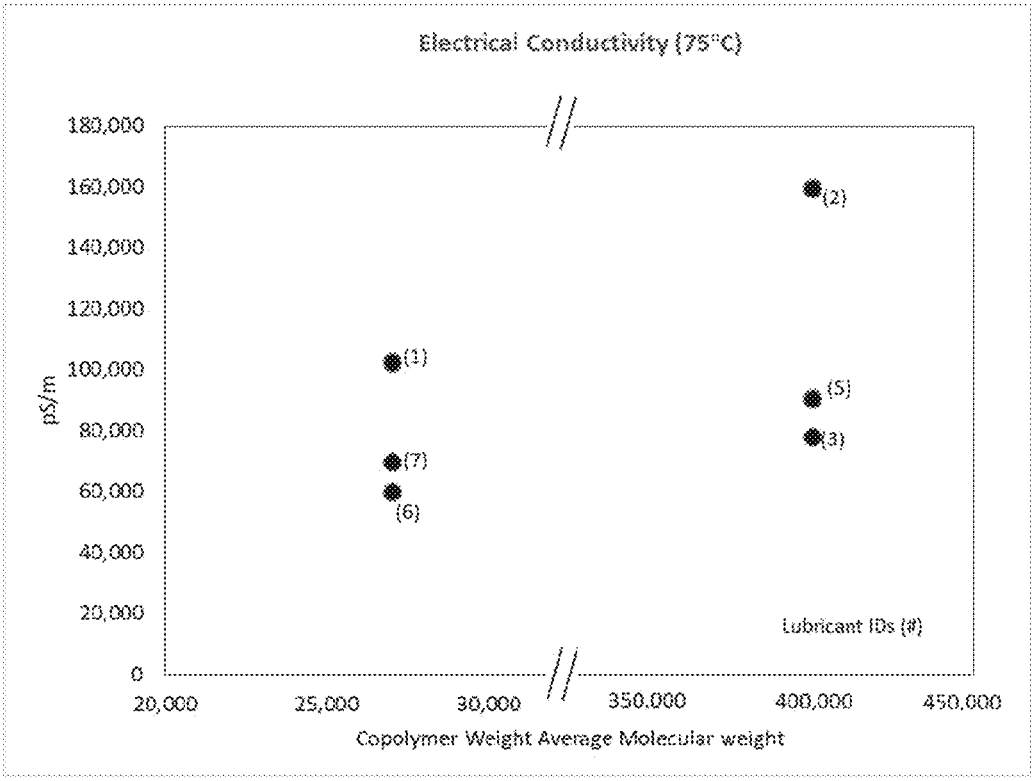
FIG. 1 is a graph of lubricant electrical conductivity per ASTM D2624-15 at 75° C.

This present disclosure relates to a method for lubricating a transmission having an electric or a hybrid-electric motor.

In one embodiment, the method comprises lubricating a transmission having the electric or the hybrid-electric motor with a lubricant. The lubricant including a poly(meth)acrylate copolymer and a solvent system including a base oil component blended with a branched diester component. The base oil component including, in one embodiment, one or more oils selected from Group I to Group V base oils, in another embodiment, one or more oils selected from Group I to Group IV base oils, and, in yet another embodiment, base oils selected from Group I, Group, II, Group III, Group IV, and/or Group V bases oils in any combination. In yet further embodiments, the poly(meth)acrylate copolymer has a weight average molecular weight of about 50,000 g/mol.

In other embodiments of the method, the branched diester component may be a reaction product of one or more dicarboxylic acids having an internal carbon chain length of 6 to 10 carbons and one or more alcohols having a branched carbon chain length of 6 to 12 carbons. The solvent system may include about 10 to about 50 weight percent of the branched diester component. The branched diester component may have the structure of Formula I:

(Formula I)

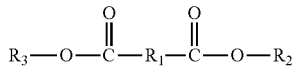

wherein $R_1$ is a carbon chain having n−2 carbons with n being an integer from 6 to 10; and $R_2$ and $R_3$ are the same or different and include C8 to C10 branched alkyl chains. The branched diester component may be selected from the group consisting of bis(6-methylheptyl) hexanedioate; bis(8-methylnonyl) hexanedioate; bis(2-ethylhexyl)decanedioate; bis(2-ethylhexyl) hexanedioate; or combinations thereof.

In any of the embodiments herein, the lubricant may also have an electrical conductivity measured per ASTM D2624-15 at 75° C. of about 80,000 pS/m or less and a thermal conductivity measured per ASTM D7896-14 at 80° C. of about 134 mW/m*K or more. In yet further embodiments, the present disclosure also relates to the use of the poly(meth)acrylate copolymer and to the solvent system including a base oil component blended with a branched diester component as described in any embodiment herein to achieve a lubricating composition having the electrical conductivity and thermal conductive as discussed in any embodiment herein.

In other embodiments, the poly(meth)acrylate copolymer may be derived from at least C1 to C4 linear or branched alkyl (meth)acrylates monomer units and C12 to C20 linear or branched alkyl (meth)acrylate monomer units and has a weight average molecular weight of about 10,000 to about 50,000 g/mol. The poly(meth)acrylate copolymer may have about 5 to about 50 mol percent monomer units derived from the C1 to C4 linear or branched alkyl (meth)acrylates and about 50 to about 95 mol percent monomer units derived from the C12 to C20 linear or branched alkyl (meth) acrylates.

The present disclosure also relates to a transmission and lubricant for an electric or a hybrid-electric vehicle. In some embodiments, the transmission and lubricant comprise a transmission having an electric or a hybrid-electric motor or component thereof and a lubricating composition of the transmission in contact with at least portions of and/or a component of the electric or the hybrid-electric motor. The lubricating composition may include, in some embodiments, (i) a solvent system having a blend of one or more base oils selected from Group I to Group V oils and a branched diester and (ii) a copolymer viscosity index improver having a weight average molecular weight of about 50,000 g/mol or less. The base oils may also include, in other embodiments, one or more oils selected from Group I to Group IV base oils, and, in yet another embodiment, base oils selected from Group I, Group, II, Group III, Group IV and/or Group V bases oils in any combination.

In other embodiments, the transmission and lubricant may include the branched diester having the structure of Formula I:

(Formula I)

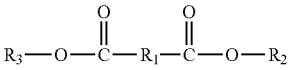

wherein $R_1$ is a carbon chain having n−2 carbons with n being an integer from 6 to 10; and $R_2$ and $R_3$ are the same or different and include C8 to C10 branched alkyl chains. The branched diester may have C6 to C12 branched alkyl groups in alcohol moieties thereof and 6 to 10 carbons in acid moieties thereof. The solvent system may include about 10 to about 50 weight percent of the branched diester. The branched diester may be selected from the group consisting of bis(6-methylheptyl) hexanedioate; bis(8-methylnonyl) hexanedioate; bis(2-ethylhexyl)decanedioate; bis(2-ethylhexyl) hexanedioate; or combinations thereof.

Any of the above embodiments may include amounts of the branched diester and amounts of the copolymer viscosity index improver effective to achieve an electrical conductivity measured per ASTM D2624-15 at 75° C. of about 80,000 pS/m or less and a thermal conductivity measured per ASTM D7896-14 at 80° C. of about 134 mW/m*K or more at the same time.

In yet other embodiments of the transmission and lubricant, the copolymer viscosity index improver includes monomer units derived from C1 to C4 linear or branched short chain alkyl (meth)acrylates and C12 to C20 linear or branched long chain alkyl (meth)acrylates and has a weight average molecular weight of about 10,000 to about 50,000 g/mol. The copolymer viscosity index improver has about 5 to about 50 mol percent monomer units derived from the short chain (meth)acrylates and about 50 to about 95 mol percent monomer units derived from the long chain (meth) acrylates.

The present disclosure also relates to a lubricating composition for electric or hybrid-electric motors. In some embodiments, the lubricating composition comprises a solvent system including one or more Group I to Group V base oils blended with a branched diester; a copolymer viscosity index improver having a weight average molecular weight of about 50,000 g/mol or less and, in some embodiments, also having a polydispersity index of about 1 to about 2. The base oils may also include, in other embodiments, one or more oils selected from Group I to Group IV base oils, and, in yet another embodiment, base oils selected from Group I, Group, II, Group III, Group IV and/or Group V bases oils in any combination. The lubricating composition may also include amounts of the branched diester in the solvent system and amounts of the copolymer viscosity index improver effective to achieve an electrical conductivity measured per ASTM D2624-15 at 75° C. of about 80,000 pS/m or less and a thermal conductivity measured per ASTM D7896-14 at 80° C. of about 134 mW/m*K or more at the same time.

In some embodiments of the lubricating composition, the branched diester of the lubricating composition may be the reaction product of one or more dicarboxylic acids having an internal carbon chain length of 6 to 10 carbons and one or more alcohols having a branched carbon chain length of 6 to 12 carbons. The solvent system may also include about 10 to about 50 weight percent of the branched diester.

In any of the above embodiments, the lubricating composition may include about 5 to about 40 weight percent of the branched diester and about 2.5 to about 17.5 weight percent of the copolymer viscosity index improver. In any of the above embodiments, the lubricating composition may also include an ester-to-copolymer weight ratio in the lubricating composition of about 1.4 to about 5.0 (solids content of copolymer). In any of the embodiments, the copolymer viscosity index improver of the lubricating composition may be derived from C1 to C4 short chain linear or branched alkyl (meth)acrylates and C12 to C20 long chain linear or branched alkyl (meth)acrylates.

DETAILED DESCRIPTION

This present disclosure describes lubricant compositions suitable for electric and hybrid-electric applications, and in particular, suitable for transmissions where the lubricating compositions come into contact with electric and/or hybrid-electric motors and components thereof and have good lubricating properties, good electrical properties, and good thermal properties. In some aspects, the lubricating compositions herein include a solvent system having a mineral and/or synthetic base oil component blended with a branched diester component; the solvent system is further combined with low weight average molecular weight poly (meth) acrylate copolymers. The lubricating compositions described herein surprisingly achieve the desired lubricating, electrical, and thermal properties required for electric and hybrid-electric applications.

In one aspect or embodiment, the solvent system herein includes one or more Group I to Group V base oils blended with select branched esters of dicarboxylic acids. In some embodiments, the solvent system herein includes a Group III base oil component. In another approach, the solvent system includes a Group IV base oil component. In any of the above embodiments, the branched diester component is a reaction product of one or more dicarboxylic acids having a specific internal carbon chain length and one or more alcohols having a specific branched carbon chain length. When blended with the low weight average molecular weight poly(meth) acrylate copolymers described herein, monoesters and diesters obtained from acids having a different internal chain length and alcohols having a linear or a different carbon length do not achieve the desired lubricant properties.

The poly(meth)acrylate copolymer described herein include at least a weight average molecular weight of less than about 50,000 g/mol and is derived from, in some approaches, at least C1 to C4 alkyl (meth)acrylates monomer units and C12 to C20 alkyl (meth)acrylate monomer units and, in other approaches, also nitrogen containing monomer units that provide dispersancy function. When blended with the solvent system of the present invention, higher molecular weight polymers and polymers of different monomer composition also do not provide the desired lubricant properties.

These new lubricant fluids including blends of the solvent systems (with the base oil component and the branched diester component) and the select low weight average molecular weight poly(meth)acrylate copolymer achieve desired lubricating properties (such as, but not limited to, kinematic viscosity, Brookfield viscosity, pour point, shear stability) and exhibit both a low electrical conductivity and a high thermal conductivity providing the desired characteristics for high performance electric and hybrid-electric vehicle applications and/or transmissions of such applications.

Branched Diester Component of the Solvent System

One component of the lubricating compositions herein is a solvent system including at least a branched diester component. In one approach, the solvent system includes select branched esters of dicarboxylic acids. This diester may be a reaction product of one or more dicarboxylic acids having an internal carbon chain length of 6 to 10 carbons and one or more alcohols having a branched carbon chain length of 6 to 12 carbons, and in other approaches, a branched carbon chain of 8 to 10 carbons, and in still yet other approaches, a branched carbon chain of 8 to 12 carbons as well as various mixtures thereof.

Suitable branched diesters include those obtained from the reaction of select dicarboxylic acids including sebacic acid, octanedioic acid; and/or adipic acid and the like and mixtures thereof with a variety of select branched alcohols including 4-methylpentanol, 3-methylpentanol, 2-methylheptanol, hexan-2-ol, 6-methylheptanol, 5-methylheptanol, 4-methylheptanol, 3-methylpentanol, 2-methylheptanol, octan-2-ol, 2-ethylhexanol, 4-ethylhexanol, 8-methylnonanol, 7-methylnonanol, 6-methylnonanol, 5-methylnonanol, 4-methylnonanol, 3-methylnonanol, 2-methylnonanol, decan2-ol, 11-methyldodecanol and the like and mixtures thereof. Specific examples of these diesters include bis(6-methylheptyl) hexanedioate, bis(8-methylnonyl) hexanedioate, bis(2-ethylhexyl) decanedioate, bis(2-ethylhexyl) hexanedioate, and the like, and combinations thereof.

Such diesters can be prepared by reacting one mole of the select dicarboxylic acid with 2 moles of the select alcohols (or mixtures thereof) as generally shown by the reaction scheme 1 below resulting in the diester of Formula (I):

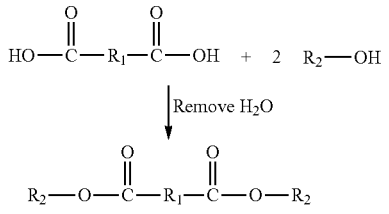

(Formula I)

wherein $R_1$ includes n−2 carbons with n being an integer from 6 to 10 and $R_2$ is the same or different (in Formula I) and includes a C6 to C12 branched alkyl chain, and in other approaches, a C8 to C10 branched alkyl chain, and in yet other approaches, a C8 to C12 branched alkyl chain, and in yet other approaches, a C6 to C10 branched alkyl chain.

Base Oil Component of the Solvent System

The solvent system herein may also include one or more mineral oils and/or other synthetic oils as the base oil component. As used herein, mineral oils and other synthetic oils refers to oils categorized by the American Petroleum Institute (API) category groups Group I to V oils. Examples of natural oils include animal oils, vegetable oils (e.g. castor oil and lard oil), and mineral oils such as petroleum oils, paraffinic, or naphthenic oils. Oils derived from coal or shale are also suitable. The American Petroleum Institute has categorized these different basestock types as follows: Group I, greater than 0.03 wt percent sulfur, and/or less than 90 vol percent saturates, viscosity index between 80 and 120; Group II, less than or equal to 0.03 wt percent sulfur, and greater than or equal to 90 vol percent saturates, viscosity index between 80 and 120; Group III, less than or equal to 0.03 wt percent sulfur, and greater than or equal to 90 vol percent saturates, viscosity index greater than 120; Group IV, all polyalphaolefins. Hydrotreated basestocks and catalytically dewaxed basestocks, because of their low sulfur and aromatics content, generally fall into the Group II and Group III categories. Polyalphaolefins (Group IV basestocks) are synthetic base oils prepared from various alpha olefins and are substantially free of sulfur and aromatics. Many Group V base oils are also true synthetic products and may include diesters, polyol esters, polyalkylene glycols, alkylated aromatics, polyphosphate esters, polyvinyl ethers, and/or polyphenyl ethers, and the like. If a Group V oil is used as a base oil component of the solvent system, such Group V oil would be in addition to the branched diester component of the solvent system discussed above.

Suitable oils may be derived from hydrocracking, hydrogenation, hydrofinishing, unrefined, refined, and re-refined oils, or mixtures thereof. Any oil blends of other base oils may be used so long as they do not detract from the desired lubricating, electrical, and thermal properties discussed above.

Unrefined oils are those derived from a natural, mineral, or synthetic source with or without little further purification treatment. Refined oils are similar to unrefined oils except that they have been treated by one or more purification steps, which may result in the improvement of one or more properties. Examples of suitable purification techniques are solvent extraction, secondary distillation, acid or base extraction, filtration, percolation, and the like. Oils refined to the quality of an edible oil may or may not be useful. Edible oils may also be called white oils. In some embodiments, lubricant compositions are free of edible or white oils.

Re-refined oils are also known as reclaimed or reprocessed oils. These oils are obtained in a manner similar to that used to obtain refined oils using the same or similar processes. Often these oils are additionally processed by techniques directed to removal of spent additives and oil breakdown products.

Mineral oils may include oils obtained by drilling, or from plants and animals and mixtures thereof. For example, such oils may include, but are not limited to, castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully-hydrogenated, if desired. Oils derived from coal or shale may also be useful.

Useful other synthetic lubricating oils may include hydrocarbon oils such as polymerized, oligomerized, or interpolymerized olefins (e.g., polybutylenes, polypropylenes, propyleneisobutylene copolymers); poly(1-hexenes), poly(1-octenes), trimers or oligomers of 1-decene, e.g., poly(1-decenes), such materials being often referred to as α-olefins, and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof.

Other synthetic lubricating oils include polyol esters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In an embodiment, oils may be prepared by a Fischer-Tropsch gas-to-liquid synthetic procedure as well as from other gas-to-liquid oils.

The base oil component of the solvent system may have a KV100 (kinematic viscosity at 100° C.) as measured per ASTM D445-18 of about 2 to about 6 cSt, about 2 to about 4 cSt, about 2 to about 3 cSt.

Solvent System

The solvent system used in the lubricant compositions herein includes a blend of the base oil component discussed above and the branched diester component discussed above and, in some embodiments, includes a blend of one or more of a Group I to Group V base oil component with the selected branched diester component. In other embodiments, the base oils are one or more oils selected from Group I to Group IV base oils, and, in yet another embodiments, base oils selected from Group I, Group II, Group III, Group IV, and/or Group V bases oils in any combination.

In some approaches, for instance, the solvent system suitable for the lubricating compositions herein includes about 10 to about 50 weight percent of the diester (based on the total weight of the solvent system), in yet other approaches, the solvent system is about 35 to about 50 weight percent diester, and in yet other approaches, about 10 to about 35 weight percent diester. In other approaches, or embodiments, the solvent system may include the diester component in amounts ranging from at least about 10 weight percent, at least about 15 weight percent, at least about 20 weight percent, at least about 25 weight percent, at least about 30 weight percent, or at least about 35 weight percent to about 50 weight percent or less, about 40 weight percent or less, about 35 weight percent or less, or about 30 weight percent or less.

The base oil component of the solvent system can be any of the base oils discussed above and selected from one or more of Group I to Group V base oils, and in some approaches, is a Group III base oil, and in other approaches is a Group IV oil.

In some approaches, for instance, the solvent system suitable for the lubricating compositions herein includes about 50 to about 95 weight percent of the base oil component (based on the total weight of the base oil in the solvent system), in yet other approaches, the solvent system is about 60 to about 90 weight percent of the base oil. In other approaches, or embodiments, the solvent system may include the base oil component in amounts ranging from at least about 50 weight percent, at least about 60 weight percent, at least about 70 weight percent, at least about 75 weight percent, at least about 80 weight percent, or at least about 85 weight percent to about 95 weight percent or less, about 85 weight percent or less, about 80 weight percent or less, or about 75 weight percent or less.

The finished lubricating compositions may include a major amount of the solvent system and, in some approaches, may include about 70 to about 98 weight percent of the solvent system, in other approaches, about 75 to about 90 weight percent, and in yet other approaches, about 75 to about 85 weight percent. In other approaches or embodiments, the lubricating compositions may include the solvent system in amounts ranging from at least about 70 weight percent, at least about 75 weight percent, at least about 80 weight percent, at least about 85 weight percent, or at least about 90 weight percent to about 98 weight percent or less, about 90 weight percent or less, about 85 weight percent or less, or about 80 weight percent or less.

The solvent systems herein, in some approaches or embodiments, including the blend of Group I to Group V base oils and the noted diesters has a KV100 of about 2 to about 8 cSt, in other approaches, about 2.5 to about 6 cSt, in yet other approaches, about 2.5 to about 3.5 cSt, and in other approaches about 2.5 to about 4.5 cSt.

Low Molecular Weight Poly(Meth)Acrylate Copolymer

Another component of the lubricating compositions herein, used in combination with the solvent system in the finished fluids, is select low weight average molecular weight poly(meth) acrylate ("PMA") copolymers. In some applications, these copolymers are viscosity index improvers and/or dispersant viscosity index improvers. Such low weight average molecular weight copolymers are derived from linear or branched alkyl esters of (meth)acrylic acid, and include select amounts of linear or branched long chain alkyl esters and linear or branched short chain alkyl esters with a polymerized molecular weight below about 50,000 g/mol.

In one approach, the copolymers herein include the reaction product in the form of a linear, random polymer of select amounts of both long and short chain alkyl (meth) acrylate monomers. In some approaches, the short chain alkyl (meth)acrylate monomers (or monomer units) have an alkyl chain length of 1 to 4 carbons and the long chain alkyl (meth)acrylate monomers (or monomer units) have an alkyl chain length of 12 to 20 carbons. These monomers and monomer units are described more below and include both linear and/or branched alkyl groups in the chain.

As used herein, the term "monomers" generally refers to the compound within the reaction mixture prior to polymerization and monomer units or (alternatively) repeating units refers to the monomer as polymerized within the polymeric backbone. The various monomers herein are randomly polymerized within the backbone as the monomer units or repeating units. If the discussion refers to a monomer, it also implies the resultant monomer unit thereof in the polymer. Likewise, if the discussion refers to a monomer unit or repeating unit, it also implies the monomer mixture used to form the polymer with the associated monomer or repeating units therein. As used herein, "(meth)acrylate" refers to both methacrylate and/or acrylate monomers or monomer units (or mixtures) as needed for an application.

Short Chain alkyl (meth)acrylate monomer units: In one embodiment, the copolymer may include about 5 to about 50 mol percent of the short chain alkyl (meth)acrylate monomers or monomer units, in other approaches, about 20 to about 50 mole percent, and in yet other approaches, about 10 to about 40 mole percent of the short chain alkyl (meth) acrylate. The short chain alkyl (meth)acrylate monomers or monomer units include those with an alkyl group or total alkyl chain length (including branching) of 1 to 4 carbon atoms and include, for example, methyl(meth)acrylate to n-butyl (meth)acrylate monomers as shown in the structures below:

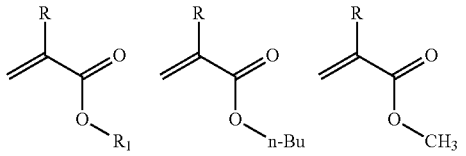

General Short Chain (Meth)acrylate n-BMA MMA where R is a hydrogen atom if the monomer or repeating unit thereof is an acrylate or $CH_3$ if the monomer or repeating unit thereof is a methacrylate and $R_1$ is a linear or branched alkyl chain or group having a total of 1 to 4 carbons.

Long Chain alkyl (meth)acrylate monomer units: In other embodiments, the copolymer may also include about 50 to about 95 mol percent of the long chain alkyl (meth)acrylate monomers or monomer units and, in other approaches, about 60 to about 90 mole percent. Long chain alkyl (meth) acrylate monomers include those with an alkyl group or a total alkyl chain length (including any branching) from 12 to 20 carbons as shown in the structures below and may include lauryl (meth)acrylate or LMA (as defined below) up to cetyl-eiosyl (meth)acrylate or CEMA (as defined below) monomer units:

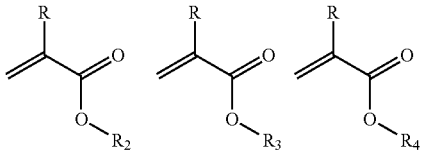

General Long chain (Meth)Acrylate CEMA LMA

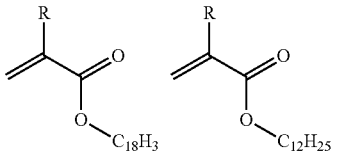

CEMA LMA where R is a hydrogen atom if the monomer or repeating unit thereof is an acrylate or $CH_3$ if the monomer or repeating unit is a methacrylate, $R_2$ is a linear or branched C12 to C20 alkyl chain or group, $R_3$ is a linear or branched C16 to C20 alkyl chain or group or a blend of C16 to C20 with the majority of alkyl chains (linear or branched) in the blend being C16 and/or C18, and $R_4$ is a linear or branched C12 to C15 alkyl chain or group or a blend of C12 to C15 with the majority in the blend being C12. The various alkyl chains may be linear or branched.

The long chain alkyl (meth)acrylate LMA or lauryl (meth) acrylate as used herein, in some approaches, includes a blend of (meth)acrylate monomers or monomer units having alkyl chain lengths ranging from C12 to C15 and, in particular, alkyl chains of 12, 14, and 15 carbons in the blend. For example, the LMA or LMA blend may include a majority of alkyl (meth)acrylate monomers or monomer units with C12 chains and further including minor amounts of monomers or monomer units with C14 and C15 chains mixed in a blend. In one approach, the LMA may include about 60 to about 75 mole percent alkyl (meth)acrylate with C12 alkyl chains (in other approaches, about 65 to about 75 mole percent C12 chains) and also include about 20 to about 30 mole percent alkyl (meth)acrylate with C14 alkyl chains (in other approaches, about 25 to about 30 C14 chains) and about 0 to about 5 mole percent alkyl (meth)acrylate with C15 alkyl chains (in other approaches, about 1 to about 2 mole percent C15 alkyl chains). Unless stated otherwise, when this disclosure refers to LMA or lauryl (meth)acrylate, the blend of the above monomers or monomer units is intended and all monomers in the blend will be randomly polymerized in their respective amounts as random monomer units or random repeating into the polymer backbone.

The long chain alkyl (meth)acrylate CEMA or cetyl-eicosyl (meth)acrylate as used herein, in some approaches, includes a blend of (meth)acrylate monomers or monomer units having alkyl chain lengths ranging from C16 to C20 and in particular 16, 18, and 20 carbons. For example, the CEMA monomer blend or monomer unit blend may include a majority of C16 and C18 chains with minor amounts of C20 chains. For simplicity herein, the CEMA monomer or monomer units may be referred to as an alkyl (meth) acrylate monomer or monomer unit with C18 alkyl chains even though it may contain a majority of C16 and/or C18 alkyl chains. In one approach, the CEMA monomer may include about 30 to about 40 mole percent alkyl (meth)acrylate with C18 alkyl chains (in other approaches, about 30 to about 35 mole percent C18 chains) and also include about 40 to about 55 mole percent alkyl (meth)acrylate with C16 alkyl chains (in other approaches, about 45 to about 53 mole percent C16 chains) and about 5 to about 20 mole percent alkyl (meth) acrylate with C20 alkyl chains (in other approaches, about 10 to about 16 mole percent C20 chains). In some approaches, the CEMA may also include up to about 5 mole percent of (meth)acrylate with alkyl chains shorter than C16 and up to 3 mole percent of alkyl chains greater than C20. Unless stated otherwise, when this disclosure refers to CEMA or cetyl-eiosyl (meth)acrylate, the blend of the above monomers or monomer units is intended and all monomers in the blend are randomly polymerized in their respective amounts as random monomer units or random repeating units into the polymer.

Additionally, and in some optional approaches, the PMA copolymers of the present disclosure are free of monomers and monomer units with intermediate alkyl chain length functionalities having total carbon chain lengths (linear or branched) of 5 to 9 carbons. As used herein, free of generally means less than about 0.5 mole percent, in other approaches, less than about 0.25 mole percent, in other approaches, less than about 0.1 mole percent, and, in other approaches none.

Optional Monomers and Monomer units: The copolymers herein may also include other optional monomers and monomer units including, for instance, hydroxyalkyl (meth) acrylate and/or various dispersant monomers and monomer units.

In one approach, the copolymers may include HEMA or 2-hydroxyethyl (meth)acrylate such as a hydroxyester (meth)acrylate having the structure shown below:

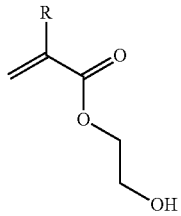

where R is a hydrogen if the monomer or repeating unit thereof is an acrylate and $CH_3$ if the monomer or repeating unit thereof is a methacrylate. In one approach, the polymer includes about 0 to about 30 mol percent of HEMA, in other approaches, about 0 to about 20 mol percent, in yet other approaches, about 0 to about 10 mole percent, and in yet other approaches, about 5 to about 15 mol percent.

The poly(meth)acrylate copolymers herein may also optionally be functionalized with one or more dispersant monomer or monomer units. For example, the polymer may include about 0 to about 10 mol percent (in other approaches, about 0 to about 6 mole percent) of one or more dispersant monomers or polymerized within the polymer backbone to provide dispersant functionality or other functionalities to the polymer. In one approach, a dispersant monomer or monomer unit may be nitrogen-containing monomers or units thereof. Such monomers, if used, may impart dispersant functionality to the polymer.

In some approaches, the nitrogen-containing monomers may be (meth)acrylic monomers such as methacrylates, methacrylamides, and the like. In some approaches, the linkage of the nitrogen-containing moiety to the acrylic moiety may be through a nitrogen atom or alternatively an oxygen atom, in which case the nitrogen of the monomer will be located elsewhere in the monomer. The nitrogen-containing monomer may also be other than a (meth)acrylic monomer, such as vinyl-substituted nitrogen heterocyclic monomers and vinyl substituted amines. Nitrogen-containing monomers include those, for instance, in U.S. Pat. No. 6,331,603. Other suitable dispersant monomers include, but are not limited to, dialkylaminoalkyl acrylates, dialkylaminoalkyl (meth)acrylates, dialkylaminoalkyl acrylamides, dialkylaminoalkyl methacrylamides, N-tertiary alkyl acrylamides, and N-tertiary alkyl methacrylamides, where the alkyl group or aminoalkyl groups may contain, independently, 1 to 8 carbon atoms. For instance, the dispersant monomer may be dimethylaminoethyl(meth)acrylate. The nitrogen-containing monomer may be, for instance, t-butyl acrylamide, dimethylaminopropyl (meth)acrylamide, dimethylaminoethyl methacrylamide, N-vinyl pyrrolidone, N-vinylimidazole, or N-vinyl caprolactam. It may also be a (meth)acrylamide based on any of the aromatic amines disclosed in WO2005/087821 including 4-phenylazoaniline, 4-aminodiphenylamine, 2-aminobenzimidazole, 3-nitroaniline, 4-(4-nitrophenylazo)aniline, N-(4-amino-5-methoxy-2-methyl-phenyl)-benzamide, N-(4-amino-2,5-dimethoxy-phenyl)-benzamide, N-(4-amino-2,5-diethoxy-phenyl)-benzamide, N-(4-amino-phenyl)-benzamide, 4-amino-2-hydroxy-benzoic acid phenyl ester, and N,N-dimethyl-phenylenediamine.

During polymerization, the monomers in the reaction mixture randomly form carbon-carbon bonds at the monomer olefin functionality to form linear, random polymers with repeating units or monomer units of carbon chains having functional moieties or side chains consistent with the concentrations of the monomers in the original reaction mixture. The various monomers are polymerized using either conventional free radical polymerization or various controlled polymerization methods as discussed more below, to form a random polymer of the general structure below:

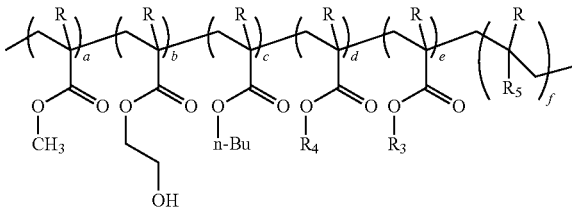

wherein, in one exemplary instance, R is a hydrogen or methyl group, a is an integer sufficient to provide about 0 to about 40 mole percent of the methyl (meth)acrylate monomer units, b is an integer sufficient to provide about 0 to about 20 mole percent of the HEMA monomer units, c is an integer sufficient to provide about 0 to about 20 mole percent of the n-BMA monomer units, d is an integer sufficient to provide about 50 to about 95 mole percent or about 60 to about 90 mole percent of the LMA monomer units, and e is an integer sufficient to provide about 0 to about 20 mole percent of the CEMA monomer units. $R_3$ and $R_4$ are as described previously. Optionally, the polymer may also include dispersant monomer units wherein $R_5$ is a moiety to provide dispersant functionality, and, thus, f is an integer sufficient to provide about 0 to about 10 mole percent of dispersant monomer units to the polymer. The structure above may also include integers a, b, c, d, and e sufficient to provide the other ranges of those monomer units as described herein. The moieties associated with the integers a through f will be randomly polymerized within the polymer The PMA polymers of the present disclosure are typically synthesized to have a weight average molecular weight of less than about 50 kg/mole, in other approaches, less than about 40 kg/mol, and in other approaches, less than about 30 kg/mol. Suitable ranges for the weight average molecular weights include, about 10 to about 50 kg/mole, in other approaches, about 15 to about 50 kg/mole, and in yet other approaches, about 15 to about 30 kg/mole. In yet other embodiments, the PMA copolymers of present disclosure may have a weight average molecular weight ranging from at least about 10, at least about 12, at least about 15, at least about 18, or at least about 20 kg/mol and less than about 50, less than about 45, less than about 40, less than about 35, or less than about 30 kg/mol. As shown in Examples, copolymers having higher weight average molecular weight than the ranges herein do not achieve all desired properties in the fluid at the same time.

The copolymers herein typically have a polydispersity index ranging from about 1 to about 3, and in other approaches, about 1.2 to about 3, and in yet other approaches, about 1.2 to about 2, and in yet other approaches, about 2 to about 3.

The poly(meth)acrylate polymers may be prepared by any suitable conventional or controlled free-radical polymerization technique. Examples include conventional free radical polymerization (FRP), reversible addition-fragmentation chain transfer (RAFT), atom transfer radial polymerization (ATRP), and other controlled types of polymerization known in the art. Polymerization procedures are known to those in the art and include, for instance, the use of common polymerization initiators (such as Vazo™ 67 (2.2'-Azobis (2-methylbutyronitrile), chain transfer agents (such as dodecyl mercaptane) if using conventional FRP, or RAFT agents (such as 4-cyano-4-[(dodecylsulfanylthiocarbonyl) sulfanyl] pentanoic acid and the like) if using RAFT polymerization. Other initiators, chain transfer agents, RAFT agents, ATRP catalyst and initiator systems can be used as known in the art depending on the selected polymerization method as needed for a particular application.

Lubricating Oil Compositions

The lubricant oil compositions of the present disclosure are suitable for lubricating transmission and other components of an electric and/or hybrid-electric vehicle and include the above described solvent system with at least one or more of the described diester compounds combined with one or more of the low molecular weight poly(meth)acrylate copolymers also discussed above. The lubricating oil composition may be a driveline oil, an automobile transmission fluid, an engine oil, and the like and is particularly suitable for lubricating and contacting components of electric and hybrid-electric vehicles including motors, generators, motor stators, and/or batteries.

In yet other approaches, the lubricating oil composition may include about 5 to about 40 weight percent of the diester as described herein based on the total weight of the lubricating oil composition. In other approaches, the lubricating oil composition may include an amount of the diester herein ranging from at least about 5 weight percent, at least about 10 weight percent, at least about 15 weight percent, at least about 20 weight percent, at least about 25 weight percent, at least about 30 weight percent, or at least about 35 weight percent and less than about 40 weight percent, less than about 35 weight percent, less than about 30 weight percent, less than about 25 weight percent, less than about 20 weight percent, less than about 15 weight percent, or less than about 10 weight percent.

In further approaches, the lubricating oil compositions may also include about 40 to about 80 weight percent of the one or more base oil based on the total weight of the lubricating oil composition. The base oil may include at least one or more Group I to Group V oils as discussed more below as long as the lubricating compositions still achieve the desired characteristics as discussed throughout this disclosure.

In another approach or embodiment, a treat rate (on a solids or an oil free basis) of the (meth)acrylate polymer discussed above in the lubricant oil composition is about 1 to about 20 weight percent, in other approaches, about 1 to about 15 weight percent, and in yet other approaches, about 5 to about 12 weight percent, and yet in other approaches, about 10 to about 12 weight percent. In some other approaches, the lubricating oil composition may include a treat rate range of the poly(meth)acrylate copolymer from at least about 1 percent, at least about 2 percent, at least about 5 percent, at least about 8 percent, or at least about 10 percent to less than about 20 percent, less than about 18 percent, less than about 15 percent, less than about 13 percent, or less than about 12 percent. In some other approaches, the lubricating oil composition may include a treat rate range of the poly(meth)acrylate copolymer from at least about 8 percent to less than about 15 percent, and in other approaches from about 10 percent to less than about 12 percent.

In other approaches, the lubricating oil compositions may also have a weight percent of ester to weight percent copolymer ratio effective to help aid in achieving the desired performance discussed herein. This ratio is a weight ratio of an amount of the select diesters discussed above to an amount of the specific poly(meth)acrylate polymers discussed herein. In one approach, the diester-to-copolymer weight ratio for the lubricant compositions herein is about 0.4 to about 5.0, in other approaches, about 1.4 to about 4.0, in yet other approaches, about 1.0 to about 3.5, and in yet other approaches, about 2.5 to about 3.0. In other embodiments, this weight ratio ranges from at least about 0.4, at least about 1.0, at least about 1.2, at least about 1.4 or at least about 2.5 and being less than about 5, less than about 4, less than about 3, less than about 2.8, or less than about 2.7, less than about 2.6, or less than about 2.5.

As used herein, the terms "oil composition," "lubrication composition," "lubricating oil composition," "lubricating oil," "lubricant composition," "fully formulated lubricant composition," and "lubricant" are considered synonymous, fully interchangeable terminology referring to the finished lubrication product comprising a major amount of a base oil component plus minor amounts of the poly(meth)acrylate copolymer and the other optional components.

In some approaches, the lubricant oil composition may be a transmission lubricant and, in such use, may have a Brookfield viscosity at −40° C. of not more than about 30,000 cP (centipoise, units of dynamic viscosity) and, in some approaches, between about 5,000 and about 20,000 cP using ASTM D2983-17. In other approaches, a kinematic viscosity at 100° C. for the lubricating compositions herein may range from about 3.5 to about 7.0 cSt, and in other approaches, about 4 to about 6.5 cSt as measured by ASTM D445-18. In yet other approaches, a kinematic viscosity at 40° C. for the lubricating compositions herein may range from about 10 to about 35 cSt, in other approaches, about 20 to about 30 cSt, and still other approaches, about 15 to about 25, and still other approaches, about 20 to about 35, as measured by ASTM D445-18.

The lubricating compositions herein not only achieve desired lubricating properties, but also electrical and cooling properties suitable for contacting electrical motors and electrical components of the electric and hybrid-electric vehicles. In one approach or embodiment, the lubricants herein not only have the above described lubricating properties but also have an electrical conductivity measured per ASTM D2624-15 at about 75° C. of about 80,000 pS/m or less (in other approaches, about 20,000 to about 80,000 pS/m at 75° C.) and, a thermal conductivity measured per ASTM D7896-14 at about 80° C. of about 134 mW/m*K or more, and about 134 to about 160 mW/m*K (in other approaches, about 134 to about 140 mW/m*K at 80° C.). While the noted performance for thermal and electrical conductivity are exemplified at about 75° C. and about 80° C. for electrical and thermal conductivity, respectively, the fluids of this disclosure will also demonstrate similar trends (that is, low electrical conductivity and high thermal conductivity at the same time) throughout the temperature range suitable for such fluids (for instance, temperatures ranging from about 20° C. up to about 180° C.), and the desired thermal and electrical performance will vary for each temperature within that range in an appropriate manner.

The lubricants herein may also include other optional additives as needed for particular applications so long as such additives do not detract from the electrical and cooling properties as discussed herein. Several common optional additives are noted below:

Optional Additive Components

In addition to the base oils as described above, the lubricating oil compositions herein may also include other additives to perform one or more functions required of a lubricating fluid. Further, one or more of the mentioned additives may be multi-functional and provide other functions in addition to or other than the function prescribed herein.

For example, the compositions herein may include one or more of at least one component selected from the group consisting of a friction modifier, an air expulsion additive, an antioxidant, a corrosion inhibitor, a foam inhibitor, a seal-swell agent, a viscosity index improver, anti-rust agent, extreme pressure additives, and combinations thereof. Other performance additives may also include, in addition to those specified above, one or more of metal deactivators, ashless TBN boosters, demulsifiers, emulsifiers, pour point depressants, and mixtures thereof. Typically, fully-formulated lubricating oils will contain one or more of these performance additives. Examples of some common optional additive components are set forth below.

Viscosity Index Improvers:

In addition to the poly(meth)acrylate copolymer described above, the lubricating oil compositions herein also may optionally contain one or more additional or supplemental viscosity index improvers. Suitable supplemental viscosity index improvers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, poly(meth)acrylates, polyacrylates, polyalkyl styrenes, hydrogenated alkenyl aryl conjugated diene copolymers, or mixtures thereof. Viscosity index improvers may include star polymers, comb polymers, and suitable examples may be described in US Publication No. 2012/0101017 A1.

The lubricating oil compositions herein also may optionally contain one or more dispersant viscosity index improvers in addition to the PMA viscosity index improver discussed above. Suitable dispersant viscosity index improvers may include functionalized polyolefins, for example, ethylene-propylene copolymers that have been functionalized with the reaction product of an acylating agent (such as maleic anhydride) and an amine; poly(meth)acrylates functionalized with an amine, or esterified maleic anhydride-styrene copolymers reacted with an amine.

The total amount of viscosity index improver and/or dispersant viscosity index improver may be 0 wt. % to 20 wt. %, 0.1 wt. % to 15 wt. %, 0.25 wt. % to 12 wt. %, or 0.5 wt. % to 10 wt. %, of the lubricating composition.

Dispersants

The lubricant composition may include one or more select dispersants or mixtures thereof. Dispersants are often known as ashless-type dispersants because, prior to mixing in a lubricating oil composition, they do not contain ash-forming metals and they do not normally contribute any ash when added to a lubricant. Ashless-type dispersants are characterized by a polar group attached to a relatively high molecular or weight hydrocarbon chain. Typical ashless dispersants include N-substituted long chain alkenyl succinimides. N-substituted long chain alkenyl succinimides include polyisobutylene (PIB) substituents with a number average molecular weight of the polyisobutylene substituent in a range of about 800 to about 2500 as determined by gel permeation chromatograph (GPC) using polystyrene (with a number average molecular weight of 180 to about 18,000) as the calibration reference. The PIB substituent used in the dispersant typically has a viscosity at 100° C. of about 2100 to about 2700 cSt as determined using ASTM D445-18. Succinimide dispersants and their preparation are disclosed, for instance in U.S. Pat. Nos. 7,897,696 and 4,234,435 which are incorporated herein by reference. Succinimide dispersants are typically an imide formed from a polyamine, typically a poly(ethyleneamine). The dispersants may include two succinimide moieties joined by a polyamine. The polyamine may be tetra ethylene penta amine (TEPA), tri ethylene tetra amine (TETA), penta ethylene hexa amine (PEHA), other higher nitrogen ethylene diamine species and/or mixtures thereof. The polyamines may be mixtures of linear, branched and cyclic amines. The PIB substituents may be joined to each succinimide moiety.

In some embodiments the lubricant composition comprises at least one polyisobutylene succinimide dispersant derived from polyisobutylene with number average molecular weight in the range about 350 to about 5000, or about 500 to about 3000, as measured by the GPC method described above. The polyisobutylene succinimide may be used alone or in combination with other dispersants.

In some embodiments, polyisobutylene (PIB), when included, may have greater than 50 mol. %, greater than 60 mol. %, greater than 70 mol. %, greater than 80 mol. %, or greater than 90 mol. % content of terminal double bonds. Such a PIB is also referred to as highly reactive PIB ("HR-PIB"). HR-PIB having a number average molecular weight ranging from about 800 to about 5000 is suitable for use in embodiments of the present disclosure. Conventional non-highly reactive PIB typically has less than 50 mol. %, less than 40 mol. %, less than 30 mol. %, less than 20 mol. %, or less than 10 mol. % content of terminal double bonds.

An HR-PIB having a number average molecular weight ranging from about 900 to about 3000, as measured by the GPC method described above, may be suitable. Such an HR-PIB is commercially available, or can be synthesized by the polymerization of isobutene in the presence of a non-chlorinated catalyst such as boron trifluoride, as described in U.S. Pat. Nos. 4,152,499 and 5,739,355. When used in the aforementioned thermal ene reaction, HR-PIB may lead to higher conversion rates in the reaction, as well as lower amounts of sediment formation, due to increased reactivity.

In some embodiments the lubricant composition comprises at least one dispersant derived from polyisobutylene succinic anhydride. In an embodiment, the dispersant may be derived from a polyalphaolefin (PAO) succinic anhydride. In an embodiment, the dispersant may be derived from olefin maleic anhydride copolymer. As an example, the dispersant may be described as a poly-PIBSA. In an embodiment, the dispersant may be derived from an anhydride which is grafted to an ethylene-propylene copolymer.

One class of suitable dispersants may be Mannich bases. Mannich bases are materials that are formed by the condensation of a higher molecular weight, alkyl substituted phenol, a polyalkylene polyamine, and an aldehyde such as formaldehyde. Mannich bases are described in more detail in U.S. Pat. No. 3,634,515.

A suitable class of dispersants may be high molecular weight esters or half ester amides.

The dispersants may also be post-treated by conventional methods by reaction with any of a variety of agents. Among these agents are boron, urea, thiourea, dimercaptothiadiazoles, carbon disulfide, aldehydes, ketones, carboxylic acids, hydrocarbon-substituted succinic anhydrides, maleic anhydride, nitriles, epoxides, carbonates, cyclic carbonates, hindered phenolic esters, and phosphorus compounds. U.S. Pat. Nos. 7,645,726; 7,214,649; and 8,048,831 describes some suitable post-treatment methods and post-treated products.

Suitable boron compounds useful in firming the dispersants herein include any boron compound or mixtures of boron compounds capable of introducing boron-containing species into the ashless dispersant. Any boron compound, organic or inorganic, capable of undergoing such reaction can be used. Accordingly, use can be made of boron oxide, boron oxide hydrate, boron trifluoride, boron tribromide, boron trichloride, $HBF_4$ boron acids such as boronic acid (e.g. alkyl-$B(OH)_2$ or aryl-$B(OH)_2$), boric acid, (i.e., $H_3BO_3$), tetraboric acid (i.e., $H_2B_5O_7$), metaboric acid (i.e., $HBO_2$), ammonium salts of such boron acids, and esters of such boron acids. The use of complexes of a boron trihalide with ethers, organic acids, inorganic acids, or hydrocarbons is a convenient means of introducing the boron reactant into the reaction mixture. Such complexes are known and are exemplified by boron trifluoride-diethyl ether, boron trifluoride-phenol, boron trifluoride-phosphoric acid, boron trichloride-chloroacetic acid, boron tribromide-dioxane, and boron trifluoride-methyl ethyl ether.

Suitable phosphorus compounds for forming the dispersants herein include phosphorus compounds or mixtures of phosphorus compounds capable of introducing a phosphorus-containing species into the ashless dispersant. Any phosphorus compound, organic or inorganic, capable of undergoing such reaction can thus be used. Accordingly, use can be made of such inorganic phosphorus compounds as the inorganic phosphorus acids, and the inorganic phosphorus oxides, including their hydrates. Typical organic phosphorus compounds include full and partial esters of phosphorus acids, such as the mono-, di-, and tri esters of phosphoric acid, thiophosphoric acid, dithiophosphoric acid, trithiophosphoric acid and tetrathiophosphoric acid; the mono-, di-, and tri esters of phosphorous acid, thiophosphorous acid, dithiophosphorous acid and trithiophosphorous acid; the trihydrocarbyl phosphine oxides: the trihydrocarbyl phosphine sulfides; the mono- and dihydrocarbyl phosphonates, (RPO(OR')(OR") where R and R' are hydrocarbyl and R" is a hydrogen atom or a hydrocarbyl group), and their mono-, di- and trithio analogs; the mono- and dihydrocarbyl phosphonites, (RP(OR')(OR") where R and R' are hydrocarbyl and R" is a hydrogen atom or a hydrocarbyl group) and their mono- and dithio analogs; and the like. Thus, use can be made of such compounds as, for example, phosphorous acid ($H_3PO_3$, sometimes depicted as $H_2(HPO_3)$, and sometimes called ortho-phosphorous acid or phosphonic acid), phosphoric acid ($H_3PO_4$, sometimes called orthophosphoric acid), hypophosphoric acid ($H_4P_2O_6$), metaphosphoric acid ($HPO_3$), pyrophosphoric acid ($H_4P_2O_7$), hypophosphorous acid ($H_3PO_2$, sometimes called phosphinic acid), pyrophosphorous acid ($H_4P_2O_5$, sometimes called pyrophosphonic acid), phosphinous acid ($H_3PO$), tripolyphosphoric acid ($H_5P_3O_{10}$), tetrapolyphosphoric acid ($H_5P_4O_{13}$), trimetaphosphoric acid ($H_3P_3O_9$), phosphorus trioxide, phosphorus tetraoxide, phosphorus pentoxide, and the like. Partial or total sulfur analogs such as phosphorotetrathioic acid ($H_3PS_4$), phosphoromonothioic acid ($H_3PO_3S$), phosphorodithioic acid ($H_3PO_2S_2$), phosphorotrithioic acid ($H_3POS_3$), phosphorus sesquisulfide, phosphorus heptasulfide, and phosphorus pentasulfide ($P_2S_5$, sometimes referred to as $P_4S_{10}$) can also be used in forming dispersants for this disclosure. Also usable are the inorganic phosphorus halide compounds such as $PCl_3$, $PBr_3$, $POCl_3$, $PSCl_3$, etc.

Likewise use can be made of such organic phosphorus compounds as mono-, di-, and triesters of phosphoric acid (e.g., trihydrocarbyl phosphates, dihydrocarbyl monoacid phosphates, monohydrocarbyl diacid phosphates, and mixtures thereof), mono-, di-, and triesters of phosphorous acid (e.g., trihydrocarbyl phosphites, dihydrocarbyl hydrogen phosphites, hydrocarbyl diacid phosphites, and mixtures thereof), esters of phosphonic acids (both "primary", $RP(O)(OR)_2$, and "secondary", $R_2P(O)(OR)$), esters of phosphinic acids, phosphonyl halides (e.g., $RP(O)Cl_2$ and $R_2P(O)Cl$), halophosphites (e.g., $(RO)PCl_2$ and $(RO)_2PCl$), halophosphates (e.g., $ROP(O)Cl_2$ and $(RO)_2P(O)Cl$), tertiary pyrophosphate esters (e.g., $(RO)_2P(O)—O—P(O)(OR)_2$), and the total or partial sulfur analogs of any of the foregoing organic phosphorus compounds, and the like wherein each hydrocarbyl group contains up to about 100 carbon atoms, or up to about 50 carbon atoms, or up to about 24 carbon atoms, or up to about 12 carbon atoms. Also usable are the halophosphine halides (e.g., hydrocarbyl phosphorus tetrahalides, dihydrocarbyl phosphorus trihalides, and trihydrocarbyl phosphorus dihalides), and the halophosphines (monohalophosphines and dihalophosphines).

The lubricants herein may include mixtures of one or more boronated and phosphorylated dispersants set forth above combined with non-boronated and non-phosphorylated dispersants.

In one embodiment the lubricating oil composition may include at least one borated dispersant, wherein the dispersant is the reaction product of an olefin copolymer or a reaction product of an olefin copolymer with succinic anhydride, and at least one polyamine. The ratio of PIBSA: polyamine may be from 1:1 to 10:1, or 1:1 to 5:1, or 4:3 to 3:1, or 4:3 to 2:1. A particularly useful dispersant contains a polyisobutenyl group of the PIBSA having a number average molecular weight (Mn) in the range of from about 500 to 5000, as determined by the GPC method described above, and a (B) polyamine having a general formula $H_2N(CH_2)_m—[NH(CH_2)_m]_n—NH_2$, wherein m is in the range from 2 to 4 and n is in the range of from 1 to 2.

In addition to the above, the dispersant may be post-treated with an aromatic carboxylic acid, an aromatic polycarboxylic acid, or an aromatic anhydride wherein all carboxylic acid or anhydride group(s) are attached directly to an aromatic ring. Such carboxyl-containing aromatic compounds may be selected from 1,8-naphthalic acid or anhydride and 1,2-naphthalenedicarboxylic acid or anhydride, 2,3-naphthalenedicarboxylic acid or anhydride, naphthalene-1,4-dicarboxylic acid, naphthalene-2,6-dicarboxylic acid, phthalic anhydride, pyromellitic anhydride, 1,2,4-benzene tricarboxylic acid anhydride, diphenic acid or anhydride, 2,3-pyridine dicarboxylic acid or anhydride, 3,4-pyridine dicarboxylic acid or anhydride, 1,4,5,8-naphthalenetetracarboxylic acid or anhydride, perylene-3,4,9,10-tetracarboxylic anhydride, pyrene dicarboxylic acid or anhydride, and the like. The moles of this post-treatment component reacted per mole of the polyamine may range from about 0.1:1 to about 2:1. A typical molar ratio of this post-treatment component to polyamine in the reaction mixture may range from about 0.2:1 to about 2:1. Another molar ratio of this post-treatment component to the polyamine that may be used may range from 0.25:1 to about 1.5:1. This post-treatment component may be reacted with the other components at a temperature ranging from about 140° to about 180° C.

Alternatively, or in addition to the post-treatment described above, the dispersant may be post-treated with a non-aromatic dicarboxylic acid or anhydride. The non-aromatic dicarboxylic acid or anhydride of may have a number average molecular weight of less than 500, as measured by the GPC method described above. Suitable carboxylic acids or anhydrides thereof may include, but are not limited to acetic acid or anhydride, oxalic acid and anhydride, malonic acid and anhydride, succinic acid and anhydride, alkenyl succinic acid and anhydride, glutaric acid and anhydride, adipic acid and anhydride, pimelic acid and anhydride, suberic acid and anhydride, azelaic acid and anhydride, sebacic acid and anhydride, maleic acid and anhydride, fumaric acid and anhydride, tartaric acid and anhydride, glycolic acid and anhydride, 1,2,3,6-tetrahydronaphthalic acid and anhydride, and the like.

The non-aromatic carboxylic acid or anhydride is reacted at a molar ratio with the polyamine ranging from about 0.1 to about 2.5 moles per mole of polyamine. Typically, the amount of non-aromatic carboxylic acid or anhydride used will be relative to the number of secondary amino groups in the polyamine. Accordingly, from about 0.2 to about 2.0 moles of the non-aromatic carboxylic acid or anhydride per secondary amino group in Component B may be reacted with the other components to provide the dispersant according to embodiments of the disclosure. Another molar ratio of the non-aromatic carboxylic acid or anhydride to polyamine that may be used may range from 0.25:1 to about 1.5:1 moles of per mole of polyamine. The non-aromatic carboxylic acid or anhydride may be reacted with the other components at a temperature ranging from about 140° to about 180° C.

The weight % actives of the alkenyl or alkyl succinic anhydride can be determined using a chromatographic technique. This method is described in column 5 and 6 in U.S. Pat. No. 5,334,321. The percent conversion of the polyolefin is calculated from the % actives using the equation in column 5 and 6 in U.S. Pat. No. 5,334,321.

The TBN of a suitable borated dispersant may be from about 10 to about 65 mg KOH/gram composition on an oil-free basis, which is comparable to about 5 to about 30 mg KOH/gram composition TBN if measured on a dispersant sample containing about 50% diluent oil.

Typically, the dispersants described above are provided in about 4.5 to about 25 weight percent and, in other approaches, about 4.5 to about 12 weight percent, and in yet other approaches, about 4.5 to about 7.7 weight percent in the lubricant.

Extreme Pressure Agents

The lubricating oil compositions herein may also optionally contain one or more extreme pressure agents. Extreme Pressure (EP) agents that are soluble in the oil include sulfur- and chlorosulfur-containing EP agents, chlorinated hydrocarbon EP agents and phosphorus EP agents. Examples of such EP agents include chlorinated wax; organic sulfides and polysulfides such as dibenzyldisulfide, bis(chlorobenzyl) disulfide, dibutyl tetrasulfide, sulfurized methyl ester of oleic acid, sulfurized alkylphenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters such as the dihydrocarbyl and trihydrocarbyl phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenyl phosphite; metal thiocarbamates such as zinc dioctyldithiocarbamate and barium heptylphenol diacid; amine salts of alkyl and dialkylphosphoric acids, including, for example, the amine salt of the reaction product of a dialkyldithiophosphoric acid with propylene oxide; and mixtures thereof.

The extreme pressure agents may be present in amount of, for example, from 0 to 3.0 wt. % or from 0.1 to 2.0 wt. %, based on the total weight of the lubricating oil composition.

Anti-Wear Agents: The lubricating oil compositions herein also may optionally contain one or more anti-wear agents. Examples of suitable antiwear agents include, but are not limited to, a metal thiophosphate; a metal dialkyldithiophosphate; a phosphoric acid ester or salt thereof; a phosphate ester(s); a phosphite; a phosphorus-containing carboxylic ester, ether, or amide; a sulfurized olefin; thiocarbamate-containing compounds including, thiocarbamate esters, alkylene-coupled thiocarbamates, and bis(S-alkyldithiocarbamyl) disulfides; and mixtures thereof. A suitable antiwear agent may be a molybdenum dithiocarbamate. The phosphorus containing antiwear agents are more fully described in European Patent 612 839. The metal in the dialkyl dithio phosphate salts may be an alkali metal, alkaline earth metal, aluminum, lead, tin, molybdenum, manganese, nickel, copper, titanium, or zinc. A useful antiwear agent may be zinc dialkyldithiophosphate.

Further examples of suitable antiwear agents include titanium compounds, tartrates, tartrimides, oil soluble amine salts of phosphorus compounds, sulfurized olefins, phosphites (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl) disulfides. The tartrate or tartrimide may contain alkyl-ester groups, where the sum of carbon atoms on the alkyl groups may be at least 8. The antiwear agent may in one embodiment include a citrate.

The antiwear agent may be present in ranges including about 0 wt % to about 15 wt %, in other approaches, about 0.01 wt % to about 10 wt %, in yet other approaches, about 0.05 wt % to about 5 wt %, or, in further approaches, about 0.1 wt % to about 3 wt % of the lubricating oil composition.

Friction Modifiers

The lubricating oil compositions herein may also optionally contain one or more friction modifiers. Suitable friction modifiers may comprise metal containing and metal-free friction modifiers and may include, but are not limited to, imidazolines, amides, amines, succinimides, alkoxylated amines, alkoxylated ether amines, amine oxides, amidoamines, nitriles, betaines, quaternary amines, imines, amine salts, amino guanidine, alkanolamides, phosphonates, metal-containing compounds, glycerol esters, sulfurized fatty compounds and olefins, sunflower oil other naturally occurring plant or animal oils, dicarboxylic acid esters, esters or partial esters of a polyol and one or more aliphatic or aromatic carboxylic acids, and the like.

Suitable friction modifiers may contain hydrocarbyl groups that are selected from straight chain, branched chain, or aromatic hydrocarbyl groups or mixtures thereof, and may be saturated or unsaturated. The hydrocarbyl groups may be composed of carbon and hydrogen or hetero atoms such as sulfur or oxygen. The hydrocarbyl groups may range from 12 to 25 carbon atoms. In some embodiments the friction modifier may be a long chain fatty acid ester. In another embodiment the long chain fatty acid ester may be a mono-ester, or a di-ester, or a (tri)glyceride. The friction modifier may be a long chain fatty amide, a long chain fatty ester, a long chain fatty epoxide derivatives, or a long chain imidazoline.

Other suitable friction modifiers may include organic, ashless (metal-free), nitrogen-free organic friction modifiers. Such friction modifiers may include esters formed by reacting carboxylic acids and anhydrides with alkanols and generally include a polar terminal group (e.g. carboxyl or hydroxyl) covalently bonded to an oleophilic hydrocarbon chain. An example of an organic ashless nitrogen-free friction modifier is known generally as glycerol monooleate (GMO) which may contain mono-, di-, and tri-esters of oleic acid. Other suitable friction modifiers are described in U.S. Pat. No. 6,723,685.

Aminic friction modifiers may include amines or polyamines. Such compounds can have hydrocarbyl groups that are linear, either saturated or unsaturated, or a mixture thereof and may contain from 12 to 25 carbon atoms. Further examples of suitable friction modifiers include alkoxylated amines and alkoxylated ether amines. Such compounds may have hydrocarbyl groups that are linear, either saturated, unsaturated, or a mixture thereof. They may contain from about 12 to about 25 carbon atoms. Examples include ethoxylated amines and ethoxylated ether amines.

The amines and amides may be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291.

A friction modifier may optionally be present in ranges such as 0 wt. % to 6 wt. %, or 0.01 wt. % to 4 wt. %, or 0.05 wt. % to 2 wt. %.

Detergents

The lubricant composition also includes one or more select detergents or mixtures thereof to provide specific amounts of metal and soap content to the lubricating composition. By one approach, the detergent is a metal containing detergent, such as neutral to overbased detergents. Suitable detergent substrates include phenates, sulfur containing phenates, sulfonates, calixarates, salixarates, salicylates, carboxylic acids, phosphorus acids, mono- and/or di-thiophosphoric acids, alkyl phenols, sulfur coupled alkyl phenol compounds and methylene bridged phenols. Suitable detergents and their methods of preparation are described in greater detail in numerous patent publications, including U.S. Pat. No. 7,732,390, and references cited therein. In one approach, the detergents are neutral to overbased sulfonates, phenates, or carboxylates with an alkali metal or alkaline earth metal salt. The detergents may be linear or branched, such as linear or branched sulfonates. Linear detergents are those that include a straight chain with no side chains attached thereto and typically include carbon atoms bonded only to one or two other carbon atoms. Branched detergents are those with one or more side chains attached to the molecule's backbone and may include carbon atoms bonded to one, two, three, or four other carbon atoms. In one embodiment the sulfonate detergent may be a predominantly linear alkylbenzenesulfonate detergent. In some embodiments the linear alkyl (or hydrocarbyl) group may be attached to the benzene ring anywhere along the linear chain of the alkyl group, but often in the 2, 3, or 4 position of the linear chain, and in some instances predominantly in the 2 position. In other embodiments, the alkyl (or hydrocarbyl) group may be branched, that is, formed from a branched olefin such as propylene or 1-butene or isobutene. Sulfonate detergents having a mixture of linear and branched alkyl groups may also be used.

The detergent substrate may be salted with an alkali or alkaline earth metal such as, but not limited to, calcium, magnesium, potassium, sodium, lithium, barium, or mixtures thereof. In some embodiments, the detergent is free of barium. A suitable detergent may include alkali or alkaline earth metal salts of petroleum sulfonic acids and long chain mono- or di-alkylarylsulfonic acids with the aryl group being one of benzyl, tolyl, and xylyl.

Overbased detergent additives are well known in the art and may be alkali or alkaline earth metal overbased detergent additives. Such detergent additives may be prepared by reacting a metal oxide or metal hydroxide with a substrate and carbon dioxide gas. The substrate is typically an acid, for example, an acid such as an aliphatic substituted sulfonic acid, an aliphatic substituted carboxylic acid, or an aliphatic substituted phenol. In general, the terminology "overbased" relates to metal salts, such as metal salts of sulfonates, carboxylates, and phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, the MR, is greater than one. Such salts are commonly referred to as overbased, hyperbased, or superbased salts and may be salts of organic sulfur acids, carboxylic acids, or phenols. The detergents may also exhibit a total base number (TBN) of about 27 to about 400 and, in other approaches, about 200 to about 400.

In transmission fluids, the detergent provides less than about 455 ppm of the metal to the lubricant composition. Higher levels of metal result in failures in one or more of the friction durability or wear tests set forth herein. In other approaches, the detergent provides about 0 to about 281 ppm of metal. In yet other approaches, the detergent provides about 0 to about 100 ppm metal to the lubricant composition.

The detergent also provides select levels of soap content to the lubricant composition and the provided soap amounts are balanced with the level of metal such that if the metal is not within the desired ranges, then increasing soap content does not achieve desired results, which is discussed in more detail in the Examples herein. By one approach, the detergent provides about 0.02 to about 0.15 percent soap content to the final lubricating composition, such as sulfonate soap, phenate soap, and/or carboxylate soap. In other approaches, the detergent provides about 0.02 to about 0.1 percent soap, and in yet other approaches, about 0.02 to about 0.05 percent soap.

Soap content generally refers to the amount of neutral organic acid salt and reflects a detergent's cleansing ability, or detergency, and dirt suspending ability. The soap content can be determined by the following formula, using an exemplary calcium sulfonate detergent (represented by $RSO_3)_vCa_w(CO_3)_x(Oh)_y$ with v, w, x, and y denoting the number of sulfonate groups, the number of calcium atoms, the number of carbonate groups, and the number of hydroxyl groups respectively):

$$\text{soap content} = \frac{\text{formula weight of } [(RSO_3)_2Ca]}{\text{effective formula weight}} \times 100$$

Effective formula weight is the combined weight of all the atoms that make up the formula $(RSO_3)_vCa_w(CO_3)_x(OH)_y$ plus that of any other lubricant components. Further discussion on determining soap content can be found in FUELS AND LUBRICANTS HANDBOOK, TECHNOLOGY, PROPERTIES, PERFORMANCE, AND TESTING, George Totten, editor, ASTM International, 2003, relevant portions thereof incorporated herein by reference.

In some approaches, the metal containing detergent is not boronated such that the boron in the lubricant is solely provided by the dispersant.

The total amount of detergent that may be present in the lubricating oil composition may be from 0 wt. % to 2 wt. %, or from about 0 wt. % to about 0.5 wt. %, or about 0 wt. % to about 0.15 wt.

Antioxidants

The lubricating oil compositions herein also may optionally contain one or more antioxidants. Antioxidant compounds are known and include for example, phenates, phenate sulfides, sulfurized olefins, phosphosulfurized terpenes, sulfurized esters, aromatic amines, alkylated diphenylamines (e.g., nonyl diphenylamine, di-nonyl diphenylamine, octyl diphenylamine, di-octyl diphenylamine), phenyl-alpha-naphthylamines, alkylated phenyl-alpha-naphthylamines, hindered non-aromatic amines, phenols, hindered phenols, oil-soluble molybdenum compounds, macromolecular antioxidants, or mixtures thereof. Antioxidant compounds may be used alone or in combination.

Useful antioxidants may include diarylamines and high molecular weight phenols. In an embodiment, the lubricating oil composition may contain a mixture of a diarylamine and a high molecular weight phenol, such that each antioxidant may be present in an amount sufficient to provide up to about 5%, by weight, based upon the final weight of the lubricating oil composition. In an embodiment, the antioxidant may be a mixture of 0.3 to 2% diarylamine and 0.4 to 2% high molecular weight phenol, by weight, based upon the final weight of the lubricating oil composition.

The one or more antioxidant(s) may be present in ranges 0 wt. % to 5 wt. %, or 0.01 wt. % to 5 wt. %, or 0.1 wt. % to 3 wt. %, or 0.8 wt. % to 2 wt. %, of the lubricating composition.

Corrosion Inhibitors

The automatic transmission lubricants may further include additional corrosion inhibitors (it should be noted that some of the other mentioned components may also have copper corrosion inhibition properties). Suitable additional inhibitors of copper corrosion include ether amines, polyethoxylated compounds such as ethoxylated amines and ethoxylated alcohols, imidazolines, monoalkyl and dialkyl thiadiazole, and the like.

Thiazoles, triazoles and thiadiazoles may also be used in the lubricants. Examples include benzotriazole; tolyltriazole; octyltriazole; decyltriazole; dodecyltriazole; 2-mercaptobenzothiazole; 2,5-dimercapto-1,3,4-thiadiazole; 2-mercapto-5-hydrocarbylthio-1,3,4-thiadiazoles; and 2-mercapto-5-hydrocarbyldithio-1,3,4-thiadiazoles. In one embodiment, the thiadiazoles are 1,3,4-thiadiazoles. In another embodiment, the thiadiazoles are 2-hydrocarbyldithio-5-mercapto-1,3,4-dithiadiazoles. A number of the thiadiazoles are available as articles of commerce.

The corrosion inhibitor, if present, can be used in an amount sufficient to provide 0 wt. % to 5 wt. %, 0.01 wt. % to t 3 wt. %, 0.1 wt. % to 2 wt. %, based upon the final weight of the lubricating oil composition.

Foam Inhibitors/Anti Foam Agents

Anti-foam/Surfactant agents may also be included in a fluid according to the present disclosure. Various agents are known for such use. In one embodiment, the agents are copolymers of ethyl acrylate and hexyl ethyl acrylate, such as PC-1244, available from Solutia. In another embodiment, the agents are silicone fluids, such as 4% DCF. In another embodiment, the agents are mixtures of anti-foam agents.

Anti-Rust Agents

Various known anti-rust agents or additives are known for use in transmission fluids, and are suitable for use in the fluids according to the present disclosure. The anti-rust agents include alkyl polyoxyalkylene ethers, such as Mazawet® 77, C-8 acids such as Neofat® 8, oxyalkyl amines such as Tomah PA-14,3-decyloxypropylamine, and polyoxypropylene-polyoxyethylene block copolymers such as Pluronic L-81.

Pour Point Depressants

Suitable pour point depressants may include polymethylmethacrylates or mixtures thereof. Pour point depressants may be present in an amount sufficient to provide from 0 wt. % to 1 wt. %, 0.01 wt. % to 0.5 wt. %, or 0.02 wt. % to 0.04 wt. %, based upon the total weight of the lubricating composition.

Seal-Swell Agents

The automatic transmission fluids of the present disclosure may further include seal swell agents. Seal swell agents such as esters, adipates, sebacates, azealates, phthalates, sulfones, alcohols, alkylbenzenes, substituted sulfolanes, aromatics, or mineral oils cause swelling of elastomeric materials used as seals in engines and automatic transmissions.

Alcohol-type seal swell agents are generally low volatility linear alkyl alcohols, such as decyl alcohol, tridecyl alcohol and tetradecyl alcohol. Alkylbenzenes useful as seal swell agents include dodecylbenzenes, tetradecylbenzenes, dinonyl-benzenes, di(2-ethylhexyl)benzene, and the like. Substituted sulfolanes (e.g, those described in U.S. Pat. No. 4,029,588, incorporated herein by reference) are likewise useful as seal swell agents in compositions according to the present disclosure. Mineral oils useful as seal swell agents in the present disclosure include low viscosity mineral oils with high naphthenic or aromatic content. Aromatic seal swell agents include the commercially available Exxon Aromatic 200 ND seal swell agent. Commercially available examples of mineral oil seal swell agents include Exxon® Necton®-37 (FN 1380) and Exxon® Mineral Seal Oil (FN 3200).

Based on the above discussion, exemplary ranges of various lubricating composition components are set forth in Table 1 below.

TABLE 1

Lubricant Composition for Electric and Hybrid-Electric applications

| Component | Suitable Ranges, Weight Percent | Preferred Ranges, Weight Percent |
|---|---|---|
| Selected PMA Copolymer | 1 to 20 | 5 to 18 |
| Diester | 5 to 40 | 10 to 37 |
| Dispersants | 4.5 to 25 | 2.0 to 12 |
| Detergents | 0 to 2 | 0 to 0.5 |
| Friction Modifiers | 0 to 6 | 0.01 to 4 |
| Other Viscosity Index Improvers | 0 to 20 | 0 to 15 |
| Antioxidants | 0 to 5 | 0.01 to 3 |
| Rust inhibitors | 0 to 1 | 0.005 to 0.5 |
| Corrosion Inhibitors | 0 to 2 | 0.1 to 2 |
| Anti-wear agents | 0 to 15 | 0 to 3 |
| Seal Swell Agents | 0 to 20 | 0 to 10 |
| Antifoam Agents | 0 to 1 | 0.005 to 0.8 |
| Extreme pressure agents | 0 to 3 | 0 to 2 |
| Base Oil | 40 to 80 | 50 to 80 |
| Total | 100 | 100 |

The percentages of each component above represent the weight percent of each component, based upon the weight of the total final lubricating oil composition. The balance of the lubricating oil composition consists of one or more base oils as defined hereinabove. Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent).

Definitions

For purposes of this disclosure, the chemical elements are identified in accordance with the Periodic Table of the Elements, CAS version, Handbook of Chemistry and Physics, 75th Ed. Additionally, general principles of organic chemistry are described in "Organic Chemistry", Thomas Sorrell, University Science Books, Sausolito: 1999, and "March's Advanced Organic Chemistry", 5th Ed., Ed: Smith, M. B. and March, J., John Wiley & Sons, New York: 2001, the entire contents of which are hereby incorporated by reference.

As used herein, the term "olefin copolymer" refers to a random and/or block polymer comprised of two or more different types of monomers, wherein all monomers contain at least one olefin (carbon-carbon double bond).

As described herein, compounds may optionally be substituted with one or more substituents, such as are illustrated generally above, or as exemplified by particular classes, subclasses, and species of the disclosure.

Unless otherwise apparent from the context, the term "major amount" is understood to mean an amount greater than or equal to 50 weight percent, for example, from about 80 to about 98 weight percent relative to the total weight of the composition. Moreover, as used herein, the term "minor amount" is understood to mean an amount less than 50 weight percent relative to the total weight of the composition.

As used herein, the term "hydrocarbyl group" or "hydrocarbyl" is used in its ordinary sense, which is well-known to those skilled in the art. Specifically, it refers to a group having a carbon atom directly attached to the remainder of a molecule and having a predominantly hydrocarbon character. Examples of hydrocarbyl groups include: (1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical); (2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, amino, alkylamino, and sulfoxy); (3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl, and imidazolyl. In general, no more than two, or as a further example, no more than one, non-hydrocarbon substituent will be present for every ten carbon atoms in the hydrocarbyl group; in some embodiments, there will be no non-hydrocarbon substituent in the hydrocarbyl group.

As used herein the term "aliphatic" encompasses the terms alkyl, alkenyl, alkynyl, each of which being optionally substituted as set forth below.

As used herein, an "alkyl" group refers to a saturated aliphatic hydrocarbon group containing 1-12 (e.g., 1-8, 1-6, or 1-4) carbon atoms. An alkyl group can be straight or branched. Examples of alkyl groups include, but are not limited to, methyl, ethyl, propyl, isopropyl, butyl, isobutyl, sec-butyl, tert-butyl, n-pentyl, n-heptyl, or 2-ethylhexyl. An alkyl group can be substituted (i.e., optionally substituted) with one or more substituents such as halo, phospho, cycloaliphatic [e.g., cycloalkyl or cycloalkenyl], heterocycloaliphatic [e.g., heterocycloalkyl or heterocycloalkenyl], aryl, heteroaryl, alkoxy, aroyl, heteroaroyl, acyl [e.g., (aliphatic) carbonyl, (cycloaliphatic)carbonyl, or (heterocycloaliphatic) carbonyl], nitro, cyano, amido [e.g., (cycloalkylalkyl)carbonylamino, arylcarbonylamino, aralkylcarbonylamino, (heterocycloalkyl) carbonylamino, (heterocycloalkylalkyl) carbonylamino, heteroarylcarbonylamino, heteroaralkyl carbonylamino alkylaminocarbonyl, cycloalkylaminocarbonyl, heterocycloalkylaminocarbonyl, arylaminocarbonyl, or heteroarylaminocarbonyl], amino [e.g., aliphaticamino, cycloaliphatic amino, or heterocycloaliphaticamino], sulfonyl [e.g., aliphatic-$SO_2$—], sulfinyl, sulfanyl, sulfoxy, urea, thiourea, sulfamoyl, sulfamide, oxo, carboxy, carbamoyl, cycloaliphaticoxy, heterocyclo aliphaticoxy, aryloxy, heteroaryloxy, aralkyloxy, heteroarylalkoxy, alkoxycarbonyl, alkyl carbonyloxy, or hydroxy. Without limitation, some examples of substituted alkyls include carboxyalkyl (such as HOOC-alkyl, alkoxycarbonylalkyl, and alkylcarbonyloxyalkyl), cyanoalkyl, hydroxyalkyl, alkoxyalkyl, acylalkyl, aralkyl, (alkoxyaryl)alkyl, (sulfonylamino) alkyl (such as (alkyl-$SO_2$-amino)alkyl), aminoalkyl, amidoalkyl, (cycloaliphatic)alkyl, or haloalkyl.

As used herein, an "alkenyl" group refers to an aliphatic carbon group that contains 2-8 (e.g., 2-12, 2-6, or 2-4) carbon atoms and at least one double bond. Like an alkyl group, an alkenyl group can be straight or branched. Examples of an alkenyl group include, but are not limited to allyl, isoprenyl, 2-butenyl, and 2-hexenyl. An alkenyl group can be optionally substituted with one or more substituents such as halo, phospho, cycloaliphatic [e.g., cycloalkyl or cycloalkenyl], heterocycloaliphatic [e.g., heterocycloalkyl or hetero cycloalkenyl], aryl, heteroaryl, alkoxy, aroyl, heteroaroyl, acyl [e.g., (aliphatic) carbonyl, (cycloaliphatic) carbonyl, or (heterocycloaliphatic)carbonyl], nitro, cyano, amido [e.g., (cycloalkylalkyl)carbonylamino, arylcarbonylamino, aralkylcarbonylamino, (hetero cycloalkyl) carbonylamino, (heterocyclo alkylalkyl) carbonylamino, heteroarylcarbonylamino, heteroaralkylcarbonylamino alkylamino carbonyl, cycloalkylaminocarbonyl, hetero cyclo alkylaminocarbonyl, arylaminocarbonyl, or heteroarylaminocarbonyl], amino [e.g., aliphaticamino, cycloaliphaticamino, heterocyclo aliphaticamino, or aliphaticsulfonylamino], sulfonyl [e.g., alkyl-$SO_2$—, cycloaliphatic-$SO_2$—, or aryl-$SO_2$—], sulfinyl, sulfanyl, sulfoxy, urea, thiourea, sulfamoyl, sulfamide, oxo, carboxy, carbamoyl, cycloaliphaticoxy, heterocycloaliphaticoxy, aryloxy, heteroaryloxy, aralkyloxy, heteroaralkoxy, alkoxycarbonyl, alkylcarbonyloxy, or hydroxy. Without limitation, some examples of substituted alkenyls include cyanoalkenyl, alkoxyalkenyl, acylalkenyl, hydroxyl alkenyl, aralkenyl, (alkoxyaryl) alkenyl, (sulfonylamino)alkenyl (such as (alkyl-$SO_2$-amino) alkenyl), aminoalkenyl, amidoalkenyl, (cycloaliphatic)alkenyl, or haloalkenyl.

As used herein, an "alkynyl" group refers to an aliphatic carbon group that contains 2-8 (e.g., 2-12, 2-6, or 2-4) carbon atoms and has at least one triple bond. An alkynyl group can be straight or branched. Examples of an alkynyl group include, but are not limited to, propargyl and butynyl. An alkynyl group can be optionally substituted with one or more substituents such as aroyl, heteroaroyl, alkoxy, cycloalkyloxy, heterocycloalkyloxy, aryloxy, heteroaryloxy, aralkyl oxy, nitro, carboxy, cyano, halo, hydroxy, sulfo, mercapto, sulfanyl [e.g., aliphaticsulfanyl or cycloaliphaticsulfanyl], sulfinyl [e.g., aliphaticsulfinyl or cycloaliphaticsulfinyl], sulfonyl [e.g., aliphatic-$SO_2$—, aliphaticamino- $SO_2$—, or cycloaliphatic-$SO_2$—], amido [e.g., aminocarbonyl, alkylaminocarbonyl, alkylcarbonylamino, cyclo alkylaminocarbonyl, heterocycloalkylaminocarbonyl, cycloalkylcarbonylamino, arylamino carbonyl, arylcarbonylamino, aralkylcarbonylamino, (heterocycloalkyl) carbonylamino, (cycloalkylalkyl) carbonylamino, heteroaralkylcarbonylamino, heteroaryl carbonylamino or heteroaryl amino carbonyl], urea, thiourea, sulfamoyl, sulfamide, alkoxycarbonyl, alkyl carbonyloxy, cyclo aliphatic, heterocycloaliphatic, aryl, heteroaryl, acyl [e.g., (cycloaliphatic) carbonyl or (hetero cyclo aliphatic)carbonyl], amino [e.g., aliphaticamino], sulfoxy, oxo, carboxy, carbamoyl, (cycloaliphatic)oxy, (heterocyclo aliphatic) oxy, or (heteroaryl) alkoxy.

As used herein, an "amino" group refers to —$NR^XR^Y$ wherein each of $R^X$ and $R^Y$ is independently hydrogen, alkyl, cycloakyl, (cycloalkyl)alkyl, aryl, aralkyl, heterocycloalkyl, (heterocycloalkyl)alkyl, heteroaryl, carboxy, sulfanyl, sulfinyl, sulfonyl, (alkyl)carbonyl, (cycloalkyl)carbonyl, ((cycloalkyl)alkyl)carbonyl, arylcarbonyl, (aralkyl)carbonyl, (heterocyclo alkyl) carbonyl, ((heterocycloalkyl)alkyl)carbonyl, (heteroaryl)carbonyl, or (heteroaralkyl) carbonyl, each of which being defined herein and being optionally substituted. Examples of amino groups include alkylamino, dialkylamino, or acylamino. When the term "amino" is not the terminal group (e.g., alkylcarbonylamino), it is represented by —$NR^X$—. $R^X$ has the same meaning as defined above.

As used herein, a "cycloalkyl" group refers to a saturated carbocyclic mono- or bicyclic (fused or bridged) ring of 3-10 (e.g., 5-10) carbon atoms. Examples of cycloalkyl groups include cyclopropyl, cyclobutyl, cyclopentyl, cyclohexyl, cycloheptyl, adamantyl, norbornyl, cubyl, octahydroindenyl, decahydro-naphthyl, bicyclo[3.2.1]octyl, bicyclo [2.2.2] octyl, bicyclo[3.3.1]nonyl, bicyclo[3.3.2]decyl, bicyclo[2.2.2]octyl, adamantyl, or ((aminocarbonyl)cycloalkyl)cycloalkyl.

As used herein, a "heterocycloalkyl" group refers to a 3-10 membered mono- or bicylic (fused or bridged) (e.g., 5- to 10-membered mono- or bicyclic) saturated ring structure, in which one or more of the ring atoms is a heteroatom (e.g., N, O, S, or combinations thereof). Examples of a heterocycloalkyl group include piperidyl, piperazyl, tetrahydropyranyl, tetrahydrofuryl, 1,4-dioxolanyl, 1,4-dithianyl, 1,3-dioxolanyl, oxazolidyl, isoxazolidyl, morpholinyl, thiomorpholyl, octahydrobenzofuryl, octahydrochromenyl, octahydrothio chromenyl, octahydroindolyl, octahydropyrindinyl, decahydroquinolinyl, octahydrobenzo[b] thiopheneyl, 2-oxa-bicyclo[2.2.2]octyl, 1-aza-bicyclo[2.2.2]octyl, 3-aza-bicyclo[3.2.1]octyl, and 2,6-dioxa-tricyclo [3.3.1.0]nonyl. A monocyclic heterocycloalkyl group can be fused with a phenyl moiety to form structures, such as tetrahydroisoquinoline, which would be categorized as heteroaryls.

A "heteroaryl" group, as used herein, refers to a monocyclic, bicyclic, or tricyclic ring system having 4 to 15 ring atoms wherein one or more of the ring atoms is a heteroatom (e.g., N, O, S, or combinations thereof) and in which the monocyclic ring system is aromatic or at least one of the rings in the bicyclic or tricyclic ring systems is aromatic. A heteroaryl group includes a benzofused ring system having 2 to 3 rings. For example, a benzofused group includes benzo fused with one or two 4 to 8 membered heterocycloaliphatic moieties (e.g., indolizyl, indolyl, isoindolyl, 3H-indolyl, indolinyl, benzo[b]furyl, benzo[b]thiophenyl, quinolinyl, or isoquinolinyl). Some examples of heteroaryl are pyridyl, 1H-indazolyl, furyl, pyrrolyl, thienyl, thiazolyl, oxazolyl, imidazolyl, tetrazolyl, benzofuryl, isoquinolinyl, benzthiazolyl, xanthene, thioxanthene, phenothiazine, dihydroindole, benzo[1,3]dioxole, benzo[b]furyl, benzo[b] thiophenyl, indazolyl, benzimidazolyl, benzthiazolyl, puryl, cinnolyl, quinolyl, quinazolyl, cinnolyl, phthalazyl, quinazolyl, quinoxalyl, isoquinolyl, 4H-quinolizyl, benzo-1,2,5-thiadiazolyl, or 1,8-naphthyridyl.

Without limitation, monocyclic heteroaryls include furyl, thiophenyl, 2H-pyrrolyl, pyrrolyl, oxazolyl, thazolyl, imidazolyl, pyrazolyl, isoxazolyl, isothiazolyl, 1,3,4-thiadiazolyl, 2H-pyranyl, 4-H-pranyl, pyridyl, pyridazyl, pyrimidyl, pyrazolyl, pyrazyl, or 1,3,5-triazyl. Monocyclic heteroaryls are numbered according to standard chemical nomenclature.

Without limitation, bicyclic heteroaryls include indolizyl, indolyl, isoindolyl, 3H-indolyl, indolinyl, benzo[b]furyl, benzo[b]thiophenyl, quinolinyl, isoquinolinyl, indolizinyl, isoindolyl, indolyl, benzo[b]furyl, bexo[b]thiophenyl, indazolyl, benzimidazyl, benzthiazolyl, purinyl, 4H-quinolizyl, quinolyl, isoquinolyl, cinnolyl, phthalazyl, quinazolyl, quinoxalyl, 1,8-naphthyridyl, or pteridyl. Bicyclic heteroaryls are numbered according to standard chemical nomenclature.

As used herein, the term "treat rate" refers to the weight percent of a component in the lubricant oil. For example, the treat rate of a specific polymer in an oil composition is the weight percent of the polymer in the composition: treat rate=(weight of the polymer in an oil free basis)/(weight of the entire composition)×100%. As mentioned above, treat rate of the polymers herein refers to the solids of the polymer absent any oil or carrier fluid used during its polymerization.

As used herein, the term "polydispersity index" is synonymous with the term "dispersity" and is equal to the (weight average molecular weight)/(number average molecular weight)

As used herein the term "viscosity index" is an arbitrary measure for the change of viscosity with variations in temperature. The viscosity index can be calculated using the Formula:

$$VI=100*[(L-U)/(L-H)],$$

where

L=kinematic viscosity at 40° C. of an oil of 0 viscosity index having the same kinematic viscosity at 100° C. as the oil whose viscosity index is to be calculated, $mm^2/s$ (cSt);

H=kinematic viscosity at 40° C. of an oil of 100 viscosity index having the same kinematic viscosity at 100° C. as the oil whose viscosity index is to be calculated $mm^2/s$ (cSt); and U=kinematic viscosity at 40° C. of the oil whose viscosity index is to be calculated $mm^2/s$ (cSt).

The weight average molecular weight (Mw) and the number average molecular weight (Mn) for any poly(meth) acrylate copolymer herein may be determined with a gel permeation chromatography (GPC) instrument obtained from Waters or the like instrument and the data processed with Waters Empower Software or the like software. The GPC instrument may be equipped with a Waters Separations Module and Waters Refractive Index detector (or the like optional equipment). The GPC operating conditions may include a guard column, 4 Agilent PLgel columns (length of 300×7.5 mm; particle size of 5μ, and pore size ranging from 100-10000 Å) with the column temperature at about 40° C. Un-stabilized HPLC grade tetrahydrofuran (THF) may be used as solvent, at a flow rate of 1.0 mL/min. The GPC instrument may be calibrated with commercially available poly(methyl methacrylate) (PMMA) standards having a narrow molecular weight distribution ranging from 960-1, 568,000 g/mol. The calibration curve can be extrapolated for samples having a mass less than 500 g/mol. Samples and PMMA standards can be in dissolved in THF and prepared at concentration of 0.1 to 0.5 wt. % and used without filtration. GPC measurements are also described in U.S. Pat. No. 5,266,223, which is incorporated herein by reference. The GPC method additionally provides molecular weight distribution information; see, for example, W. W. Yau, J. J. Kirkland and D. D. Bly, "Modern Size Exclusion Liquid Chromatography", John Wiley and Sons, New York, 1979, also incorporated herein by reference.

As discussed, the lubricants herein are particularly suited for electric and hybrid-electric vehicles. Electric vehicles are those including, but not limited to, a battery, such a lead battery, a nickel-hydrogen battery, a lithium-ion battery, and/or a fuel cell, and equipped with an electric motor. Hybrid-electric vehicles are those employing batteries, an electric motor, and an internal combustion engine in combination. The lubricants herein may be in contact with parts of the electric motor and/or may be used for both the transmission and for cooling and lubricating the motor. For example, the lubricating compositions herein may be in contact with electrical windings in the stator.

A better understanding of the present disclosure and its many advantages may be clarified with the following examples. The following examples are illustrative and not limiting thereof in either scope or spirit. Those skilled in the art will readily understand that variations of the components, methods, steps, and devices described in these examples can be used. Unless noted otherwise or apparent from the context of discussion in the Examples below and throughout this disclosure, all percentages, ratios, and parts noted in this disclosure are by weight. Unless otherwise described, exemplary polymer reactions described herein and throughout this disclosure were generally performed in a 500 mL flask with overhead stirring, a condenser, temperature probe, and nitrogen supply. When necessary, the reactions were heated using an isomantle.

EXAMPLES

Comparative and Inventive lubricating oil compositions were evaluated for traditional lubricating properties of kinematic viscosity, Brookfield viscosity, pour point and electrical and thermal properties. Kinematic viscosity was measured using the procedures of ASTM D445-18t at 100° C. and 40° C. Brookfield viscosity was measured at −40° C. according to ASTM D2983-17. Pour point was measured according to ASTM D5949-16. Electrical conductivity was measured according to the procedures of ASTM D2624-15. Thermal conductivity was measured according to the procedures of ASTM D7896-14.

In general, for a lubricant to function in high performance electric and hybrid-electric vehicle applications (such as transmissions), the fluids should exhibit a low electrical conductivity (such as, but not limited to, below about 80,000 pS/m at 75° C. for instance) and exhibit high thermal conductivity (such as above 134 mW/m*k at 80° C. for instance). The evaluated temperature range for thermal and electrical conductivity in this Example was selected for demonstration only. Fluids of this disclosure will also demonstrate similar trends (that is, low electrical conductivity and high thermal conductivity) at other temperature ranges suitable for such fluids (for instance, temperatures ranging from about 20° C. up to about 180° C.), but desired values will vary for each specific temperature.

The following esters and poly(meth)acrylate copolymers were tested herein:

- Branched Diester 1 (BD1): bis(8-methylnonyl) hexanedioate was a branched diester having 6 internal carbons in the acid moiety and 10 branched carbons in the alcohol moiety. This branched diester had a KV100 of 3.6 cSt, a KV40 of 13.9 cSt, a viscosity index of 142.6, a flash point of 231° C., a Brookfield viscosity at −40° C. of 2959 cP, and a pour point of −49° C.
- Branched Diester 2 (BD2): bis(2-ethylhexyl) decanedioate was a branched diester having 10 internal carbons in the acid moiety and 8 branched carbons in the alcohol moiety. This branched diester had a KV100 of 3.2 cSt, a KV40 of 11.5 cSt, a viscosity index of 152.6, a flash point of 202.5, a Brookfield viscosity at −40° C. of 1450, and a pour point of −51° C.
- Linear Monoester 1 (LM1): octyl octanoate was a monoester having 8 carbons in the acid moiety and 8 linear carbons in the alcohol moiety. This monoester had a KV100 of 1.3 cSt, a KV40 below the detection limit, a flash point of greater than about 113° C., a Brookfield viscosity at −40° C. that was too viscous to measure, and a pour point of −22° C.
- Branched Diester 3 (BD3): diisobutyl adipate was a branched diester having 6 internal carbons in the acid moiety and 4 branched carbons in the alcohol moiety. This branched diester had a KV100 of 1.4 cSt, a KV40 below the detection limit, a flash point of 130.4, a Brookfield viscosity at −40° C. that was too viscous to measure, and a pour point of −39° C.
- Copolymer 1 (CP1): a low molecular weight polymethacrylate copolymer having a weight average molecular weight of about 27,000 g/mol, a number average molecular weight of about 16,000 g/mol, and a polydispersity index of about 1.69. This copolymer was prepared by conventional free radical polymerization using about 0.3 mol percent 2.2'-azobis(2-methylbutyronitrile) polymerization initiator, about 1.2 mol percent dodecyl mercaptan chain transfer agent, about 30.5 mol percent of methyl methacrylate, about 63.6 mol percent of lauryl methacrylate, and about 4.4 mol percent of N-[3-(dimethylamino)propyl] methacrylamide. Solid polymer content of CP1 was about 75.0 wt % in diluent oil.
- Copolymer 2 (CP2): a high molecular weight polymethacrylate copolymer having a weight average molecular weight of about 400,000 g/mol, a number average molecular weight of about 126,000 g/mol, and a polydispersity index of about 3.2. This copolymer was prepared by conventional free radical polymerization using about 0.17 mol percent 2.2'-azobis(2-methylbutyronitrile) polymerization initiator, about 0.056 mol percent dodecyl mercaptan chain transfer agent, about 16.9 mol percent of n-butyl methacrylate, about 71.9 mol percent of lauryl methacrylate, about 4.5 mol percent of cetyl-eicosyl methacrylate, and about 6.4 mol percent of N-[3-(dimethylamino)propyl] methacrylamide. Solid polymer content of CP2 was about 32.0 wt % in diluent oil.

Example 1

Figure 2:
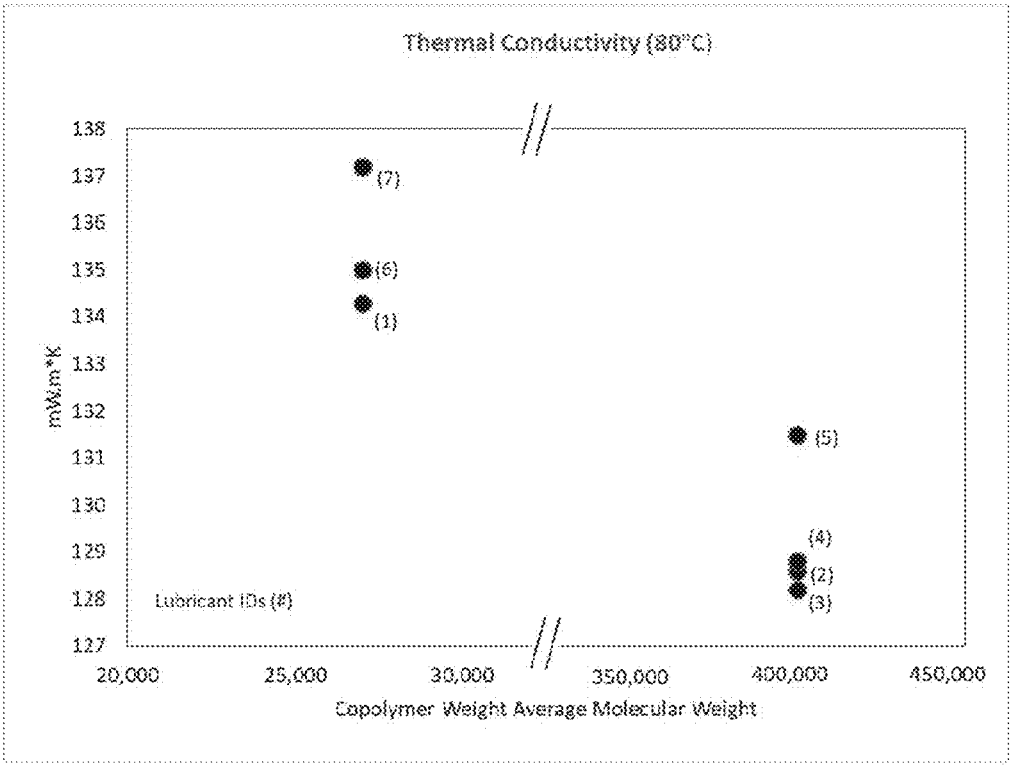
FIG. 2 is a graph of lubricant thermal conductivity per ASTM D7896-14 at 80° C.

Lubricating oil compositions of the above esters and copolymers were prepared using 6.9 weight percent of the same additive package in each lubricant and varying amounts of a mineral oil component (Ultra S2 from Phillips 66, a Group III base oil) in the solvent system, an ester component in the solvent system (mono or diester), a copolymer of different molecular weights, and total amounts of the solvent system in the lubricant. The lubricant compositions are shown in Table 2 below and evaluated properties of the compositions are provided in Table 3 as well as in FIGS. 1 and 2. The solvent systems used in the lubricants are shown in table 4.

TABLE 2

Lubricating Oil Compositions

| Lubricant ID | | Ester ID | Ester % in Lubricant | Copolymer ID | Copolymer % in Lubricant* | Base Oil % in Lubricant | Solvent System % in Lubricant | Ester to CP Ratio |
|---|---|---|---|---|---|---|---|---|
| 1 | Comparative | BD3 | 27.8 | CP1 | 14.4 | 46.3 | 74.1 | 1.9 |
| 2 | Comparative | BD3 | 32.2 | CP2 | 2.4 | 53.7 | 85.9 | 13.4 |
| 3 | Comparative | BD3 | 8.6 | CP2 | 2.2 | 77.8 | 86.4 | 3.9 |
| 4 | Comparative | BD3 | 42.8 | CP2 | 2.5 | 42.8 | 85.5 | 17.1 |
| 5 | Comparative | LM1 | 32.0 | CP2 | 2.6 | 53.3 | 85.3 | 12.3 |
| 6 | Inventive | BD1 | 26.9 | CP1 | 10.5 | 49.3 | 79.0 | 2.6 |
| 7 | Inventive | BD2 | 29.4 | CP1 | 11.1 | 49.0 | 78.4 | 2.7 |

*The treat rate of the polymers refers to the solids content of the polymer absent any oil or carrier fluid used during its polymerization.

TABLE 3

Properties of the Lubricating Compositions

| Lubricant ID | Overall Lubricant Properties KV100, cSt | KV40, cSt | BV-40, cP | Pom Point, ° C. | Electric Properties Electrical Conductivity (75° C.), pS/M | Cooling Properties Thermal Conductivity (80° C.), mW/m*k |
|---|---|---|---|---|---|---|
| 1 | 6.4 | 23.7 | 2959 | −66 | 102,400 | 134.3 |
| 2 | 6.4 | 23.7 | TVTM | −63 | 159,566 | 128.6 |
| 3 | 6.4 | 21.5 | 1940 | −66 | 78,000 | 128.2 |
| 4 | 6.4 | 20.2 | 1610 | −64 | >>200,000 | 128.8 |
| 5 | 6.4 | 19.7 | 3720 | −62 | 90,500 | 131.5 |
| 6 | 6.4 | 26.0 | 3940 | −61 | 59,866 | 135 |
| 7 | 6.5 | 25.6 | 3749 | −61 | 69,800 | 137.2 |

TVTM-too viscous to measure

TABLE 4

Properties of the Solvent System

| Lubricant ID | Ester in Solvent System, % | Base oil KV100, cSt | Base Oil and ester blend, KV100, cSt |
|---|---|---|---|
| 1 | 37.5 | 2.3 | 1.9 |
| 2 | 37.5 | 2.3 | 1.9 |
| 3 | 10 | 2.3 | 2.2 |
| 4 | 50 | 2.3 | 1.8 |
| 5 | 37.5 | 2.3 | 1.8 |
| 6 | 37.5 | 2.3 | 2.7 |
| 7 | 37.5 | 2.3 | 2.6 |

Only inventive lubricants IDs 6 and 7 with the low weight average molecular weight copolymer combined with the select solvent system having the branched diesters discussed herein were able to achieve both low electrical conductivity and high thermal conductivity suitable for high performance electric and hybrid-electric applications. While lubricants IDs 3 and 5 had relatively low electrical conductivity, both fluids had relatively low thermal conductivity and, thus, would not have the desired cooling capacity for electric or hybrid-electric vehicle applications. Likewise, while lubricant ID 1 had relatively good thermal conductivity when combined with a low molecular weight copolymer CP1, this fluid did not use the select solvent system including diesters described herein and, thus, it had relatively poor electrical conductivity (and the worst electrical conductivity using the low molecular weight polymers).

Notably, even though the solvent system of lubricant IDs1 to 4 included a branched diester (BD3), it did not have the select internal and branched chain lengths discovered for performance herein and, thus, these comparative fluids demonstrate that even small changes to the diester component dramatically altered the performance in the context of electric and hybrid applications because such lubricants did not achieve the desired electrical and thermal properties. It was unexpected that such subtle changes in solvent system diester component would have resulted in the large impact on fluid properties when combined with the low molecular weight poly(meth)acrylate copolymers herein.

Example 2

Lubricating oil compositions of the above esters and copolymers were prepared using a synthetic PAO base oil component. In this Example, the fluids used 6.9 weight percent of the same additive package in each lubricant and varied amounts of a synthetic PAO base oil component (SpectraSyn2 from Exxon Mobil Chemicals, a Group IV PAO base oil) in the solvent system, a diester component in the solvent system, a copolymer with different molecular weights, and total amounts of the solvent system in the lubricant. The lubricant compositions are show in Table 5 below and evaluated properties of the compositions are provided in Table 6. The solvent systems used in the lubricants are shown in table 7.

TABLE 5

Lubricating Oil Compositions

| Lubricant ID | Ester ID | Ester % in Lubricant | Copolymer ID | Copolymer % in Lubricant* | PAO % in Lubricant | Solvent System % in Lubricant | Ester to CP Ratio |
|---|---|---|---|---|---|---|---|
| 8 Comparative | BD3 | 31.6 | CP2 | 2.9 | 52.6 | 84.3 | 10.9 |
| 9 Inventive | BD1 | 28.3 | CP1 | 13.2 | 47.2 | 75.5 | 2.1 |
| 10 Inventive | BD1 | 38.7 | CP1 | 11.9 | 38.7 | 77.3 | 3.3 |

*The treat rate of the polymers refers to the solids content of the polymer absent any oil or carrier fluid used during its polymerization.

TABLE 6

Properties of the Lubricating Compositions

| Lubricant ID | Overall Lubricant Properties KV100, cSt | KV40, cSt | BV-40, cP | Pour Point, ° C. | Electric Properties Electrical Conductivity (75° C.), pS/M | Cooling Properties Thermal Conductivity (80°), mW/m*k |
|---|---|---|---|---|---|---|
| 8 | 6.4 | 25.4 | 2550 | −66 | 148,000 | 131.2 |
| 9 | 6.4 | 24.4 | 2490 | −67 | 60,733 | 138.7 |
| 10 | 6.4 | 24.4 | 2800 | −66 | 64,000 | 138.5 |

TVTM-too viscous to measure

TABLE 7

Properties of the Solvent System

| Lubricant ID | Ester in Solvent System, % | PAO KV100, cSt | PAO and ester blend, KV100, cSt |
|---|---|---|---|
| 8 | 37.5 | 1.7 | 1.6 |
| 9 | 37.5 | 1.7 | 2.2 |
| 10 | 50.0 | 1.7 | 2.4 |

Lubricant properties when using Group IV PAO base oils in the select solvent systems herein exhibited similar results as Example 1. Only inventive lubricants IDs 9 and 10 with the low weight average molecular weight copolymer combined with the select solvent system including the branched diesters discussed herein were able to achieve both low electrical conductivity and high thermal conductivity suitable for high performance electric and hybrid-electric applications. Comparative lubricant ID 8 had relatively poor electrical conductivity and relatively poor thermal conductivity.

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, for example, a range from 1 to 4 is to be interpreted as an express disclosure of the values 1, 2, 3 and 4 as well as any range of such values.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range. That is, it is also further understood that any range between the endpoint values within the broad range is also discussed herein. Thus, a range from 1 to 4 also means a range from 1 to 3, 1 to 2, 2 to 4, 2 to 3, and so forth.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A method for lubricating a transmission having an electric or a hybrid-electric motor, the method comprising:

lubricating a transmission having an electric or a hybrid-electric motor with a lubricant;

the lubricant including a poly(meth)acrylate copolymer and a solvent system including a base oil component blended with a branched diester component, the solvent system having about 10 to about 50 weight percent of the branched diester component;

the base oil component including one or more oils selected from Group I to Group V base oils;

the poly(meth)acrylate copolymer has a weight average molecular weight of about 50,000 g/mol or less; and wherein the branched diester component and the poly (meth)acrylate copolymer are effective so that the lubricant exhibits an electrical conductivity measured per ASTM D2624-15 at 75° C. of about 80,000 pS/m or less and a thermal conductivity measured per ASTM D7896-14 at 80° C. of about 134 mW/m*K or more.

2. The method of claim 1, wherein the branched diester component is a reaction product of one or more dicarboxylic acids having an internal carbon chain length of 6 to 10 carbons and one or more alcohols having a branched carbon chain length of 6 to 12 carbons.

3. The method of claim 1, wherein the branched diester component has the structure of Formula I:

(Formula I)

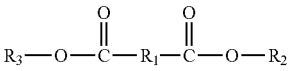

wherein $R_1$ is a carbon chain having n−2 carbons with n being an integer from 6 to 10; and $R_2$ and $R_3$ are the same or different and include C8 to C10 branched alkyl chains.

4. The method of claim 1, wherein the branched diester component is selected from the group consisting of bis(6-methylheptyl) hexanedioate; bis(8-methylnonyl) hexanedioate; bis(2-ethylhexyl) decanedioate; bis(2-ethylhexyl) hexanedioate; and combinations thereof.

5. The method of claim 1, wherein the poly(meth)acrylate copolymer is derived from at least C1 to C4 linear or branched alkyl (meth)acrylates monomer units and C12 to C20 linear or branched alkyl (meth)acrylate monomer units and has a weight average molecular weight of about 10,000 to about 50,000 g/mol.

6. The method of claim 5, wherein the poly(meth)acrylate copolymer has about 5 to about 50 mol percent monomer units derived from the C1 to C4 linear or branched alkyl (meth)acrylates and about 50 to about 95 mol percent monomer units derived from the C12 to C20 linear or branched alkyl (meth)acrylates.

7. A transmission and lubricant for an electric or a hybrid-electric vehicle, the transmission and lubricant comprising:

a transmission having an electric or a hybrid-electric motor thereof;

a lubricating composition of the transmission in contact with at least portions of the electric or the hybrid-electric motor; and the lubricating composition including (i) an solvent system having a blend of one or more base oils selected from Group I to Group V oils and a branched diester, the solvent system having about 10 to about 50 weight percent of the branched diester and (ii) a copolymer viscosity index improver having a weight average molecular weight of about 50,000 g/mol or less; and wherein the lubricating composition includes amounts of the branched diester and amounts of the copolymer viscosity index improver effective to achieve an electrical conductivity measured per ASTM D2624-15 at 75° C. of about 80,000 pS/m or less and a thermal conductivity measured per ASTM D7896-14 at 80° C. of about 134 mW/m*K or more.

8. The transmission and lubricant of claim 7, wherein the branched diester has the structure of Formula I:

(Formula I)

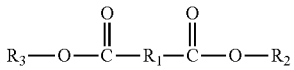

wherein $R_1$ is a carbon chain having n−2 carbons with n being an integer from 6 to 10; and $R_2$ and $R_3$ are the same or different and include C8 to C10 branched alkyl chains.

9. The transmission and lubricant of claim 7, wherein branched diester has C6 to C12 branched alkyl groups in alcohol moieties thereof and 6 to 10 carbons in acid moieties thereof.

10. The transmission and lubricant of claim 7, wherein the branched diester is selected from the group consisting of bis(6-methylheptyl) hexanedioate; bis(8-methylnonyl) hexanedioate; bis(2-ethylhexyl) decanedioate; bis(2-ethylhexyl) hexanedioate; and combinations thereof.

11. The transmission and lubricant of claim 7, wherein the copolymer viscosity index improver includes monomer units derived from C1 to C4 linear or branched short chain alkyl (meth)acrylates and C12 to C20 linear or branched long chain alkyl (meth)acrylates and has a weight average molecular weight of about 10,000 to about 50,000 g/mol.

12. The transmission and lubricant of claim 11, wherein the copolymer viscosity index improver has about 5 to about 50 mol percent monomer units derived from the short chain (meth)acrylates and about 50 to about 95 mol percent monomer units derived from the long chain (meth)acrylates.

13. A lubricating composition for electric or hybrid-electric motors, the lubricating composition comprising:

a solvent system including one or more Group I to Group V base oils blended with a branched diester, wherein the solvent system has about 10 to about 50 weight percent of the branched diester;

a copolymer viscosity index improver having a weight average molecular weight of about 50,000 g/mol or less and a polydispersity index of about 1 to about 2; and wherein the lubricating composition includes amounts of the branched diester in the solvent system and amounts of the copolymer viscosity index improver effective to achieve an electrical conductivity measured per ASTM D2624-15 at 75° C. of about 80,000 pS/m or less and a thermal conductivity measured per ASTM D7896-14 at 80° C. of about 134 mW/m*K or more at the same time.

14. The lubricating composition of claim 13, wherein the branched diester is the reaction product of one or more dicarboxylic acids having an internal carbon chain length of 6 to 10 carbons and one or more alcohols having a branched carbon chain length of 6 to 12 carbons.

15. The lubricating composition of claim 13, wherein the lubricating composition includes about 5 to about 40 weight percent of the branched diester and about 8 to about 15 weight percent of the copolymer viscosity index improver on an oil-free basis.

16. The lubricating composition of claim 13, wherein an ester-to-copolymer weight ratio in the lubricating composition of about 1.4 to about 5.0, wherein the copolymer is measured on an oil-free basis.

17. The lubricating composition of claim 13, wherein the copolymer viscosity index improver derived from C1 to C4 short chain linear or branched alkyl (meth)acrylates and C12 to C20 long chain linear or branched alkyl (meth)acrylates.

* * * * *